US007448837B2

(12) United States Patent
Oota

(10) Patent No.: US 7,448,837 B2
(45) Date of Patent: Nov. 11, 2008

(54) BOOKBINDING APPARATUS

(75) Inventor: Ryuichi Oota, Naga-gun (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 577 days.

(21) Appl. No.: 10/518,922

(22) PCT Filed: Dec. 26, 2003

(86) PCT No.: PCT/JP03/16861

§ 371 (c)(1),
(2), (4) Date: Dec. 23, 2004

(87) PCT Pub. No.: WO2004/060693

PCT Pub. Date: Jul. 22, 2004

(65) Prior Publication Data

US 2005/0238462 A1 Oct. 27, 2005

(30) Foreign Application Priority Data

Dec. 27, 2002 (JP) ..... 2002-380361
Dec. 27, 2002 (JP) ..... 2002-380393
Dec. 19, 2003 (JP) ..... 2003-422715

(51) Int. Cl.
*B42B 5/00* (2006.01)

(52) U.S. Cl. ..... 412/37; 412/33; 412/9

(58) Field of Classification Search ..... 412/8, 412/10, 11, 13, 14, 18, 33, 37, 902; 156/441.5, 156/442, 442.3, 442.1, 442.2, 442.4, 556, 156/558, 578; 222/146.5
See application file for complete search history.

(56) References Cited

U.S. PATENT DOCUMENTS 3,419,193 A * 12/1968 Stewart et al. ..... 222/183
3,956,057 A * 5/1976 Jung ..... 156/578
3,973,515 A * 8/1976 DeMand ..... 118/202
4,009,071 A * 2/1977 Snellman et al. ..... 156/563
4,116,750 A * 9/1978 Lewis et al. ..... 156/563
4,295,573 A * 10/1981 Terry et al. ..... 215/348

(Continued)

FOREIGN PATENT DOCUMENTS

JP 55-035168 3/1980

(Continued)

*Primary Examiner*—Derris H. Banks
*Assistant Examiner*—Jamila Williams
(74) *Attorney, Agent, or Firm*—Buchanan Ingersoll & Rooney PC

(57) ABSTRACT

In a bookbinding apparatus (1) comprising an adhesive tank (23) for retaining therein an adhesive melted by heat, a roller (24) ratatably supported with the adhesive tank so as to dip a lower portion thereof in the adhesive retained in the adhesive tank, for applying the adhesive to a sheet stack along a lateral edge thereof, and a holding unit (18) capable of holding the sheet stack, an adhesive tank carrier (76, 78), the movably constituted adhesive tank (23) and the roller (24) are disposed at a stand-by position located outside a longitudinal end face of the sheet stack held by the holding unit (18) in a stand-by stage so that the adhesive tank is contactlessly heated to melt the adhesive, and are moved together from the stand-by position in a longitudinal direction of the sheet stack substantially through an entire area under a back face thereof in a bookbinding stage.

15 Claims, 22 Drawing Sheets

U.S. PATENT DOCUMENTS 4,485,942 A * 12/1984 Petrecca ..... 222/146.5
5,003,916 A * 4/1991 Donley ..... 118/429
5,219,453 A * 6/1993 Furukawa et al. ..... 412/33
5,749,500 A * 5/1998 Kraus et al. ..... 222/377
6,432,511 B1 * 8/2002 Davis et al. ..... 428/156
6,726,425 B1 * 4/2004 Schmidknoz ..... 412/8

FOREIGN PATENT DOCUMENTS

JP 08216549 A * 8/1996
JP 09-156249 6/1997
WO 2004/060693 A1 7/2004

* cited by examiner

BOOKBINDING APPARATUS

TECHNICAL FIELD

The present invention relates to a compact and simple bookbinding apparatus to be used in an office, school, home, etc., which applies a hot-melt adhesive in a melted state to a lateral face of a sheet stack corresponding to a back of a book.

BACKGROUND ART

Up until now, small bookbinding apparatuses for binding a book in a simple manner by applying an adhesive to a sheet stack have been popularly used in an office, school, home, etc. Most of such bookbinding apparatuses require a cover specifically designed for the apparatus, provided with a hot-melt adhesive applied in advance to an inner face of its spine. A sheet stack enclosed in such cover is set in the bookbinding apparatus, and a heater of the apparatus melts the adhesive provided inside the cover, thereby bonding the sheet stack and the cover together.

However, since a specifically designed cover having a predetermined spine width is used in this type of bookbinding apparatus, a thickness of the sheet stack to be bound does not always fit the spine width of the cover. In such a case a gap is produced between the cover and an uppermost page of the sheet stack, thereby degrading the finish of the book. Besides, this type of bookbinding apparatus cannot be used for pad binding, which is a method of binding a paper pad coated with an adhesive without enclosing in a cover.

Accordingly, in order to bind a cover in accordance with a thickness of a sheet stack, or to perform the pad binding, a bookbinding apparatus that applies a melted adhesive to an end face of a paper pad with a roller and solidifies the adhesive on a flat plate has come to be used. As an example of such type of bookbinding apparatus, Japanese unexamined patent publication No.H09-156249 discloses a bookbinding apparatus that applies an adhesive to a lower face of a sheet stack by conveying the sheet stack held by a paper holder so as to pass over a coating roller.

However, in this bookbinding apparatus, since the sheet stack moves back and forth over the roller together with the paper holder, in a longitudinal direction along the back of the sheet stack, the apparatus has to be at least wider than a double of the length of the sheet stack; therefore it is difficult to make the apparatus smaller in size. On the other hand, some bookbinding apparatuses are designed such that the sheet stack moves back and forth in a widthwise direction (i.e. thicknesswise direction) on a roller longer than a length of the sheet stack, to apply an adhesive to the back of the sheet stack. Such a bookbinding apparatus can be made smaller in widthwise dimension, since the sheet stack moves in a widthwise direction (thicknesswise direction) thereof.

However, these types of bookbinding apparatus are generally provided with an adhesive tank having a large capacity, to replenish the adhesive less frequently. Especially in case of a bookbinding apparatus that moves a sheet stack in a widthwise direction, since the roller has to be sufficiently long, the adhesive tank for retaining the adhesive to be applied to the sheet stack with the roller naturally has to be long, and hence has a large capacity. And in case where the adhesive tank is large, it takes a longer time in melting the adhesive retained therein, and therefore a start-up period is prolonged, before entering a stand-by state where the apparatus becomes ready to operate. Besides, a larger amount of adhesive volatilizes from the adhesive tank, resulting in increase of smell of resin or rubber contained in the adhesive melted by a high temperature.

Accordingly, it is an object of the present invention to provide a small-sized bookbinding apparatus that can quickly start up to enter a stand-by state.

DISCLOSURE OF THE INVENTION

With an object to solve the foregoing technical problem, the present invention provides a bookbinding apparatus constituted as under.

A first aspect of the present invention provides a bookbinding apparatus comprising a movable adhesive tank for retaining therein an adhesive melted by heat; a roller ratatably supported with the adhesive tank so as to dip a lower portion thereof in the adhesive retained in the adhesive tank, for applying the adhesive to a sheet stack along a lateral edge thereof; a holding unit capable of holding the sheet stack; an adhesive tank carrier for disposing the adhesive tank and the roller at a stand-by position located outside a longitudinal end face of the sheet stack held by the holding unit in a stand-by stage, and moving the adhesive tank and the roller together from the stand-by position in a longitudinal direction of the sheet stack substantially through an entire area under a back face thereof in a bookbinding stage; and a non-contact heater for contactlessly heating the adhesive tank disposed at the stand-by position to melt the adhesive.

In the first aspect, the bookbinding apparatus is a type that applies the hot-melted adhesive to the sheet stack for binding. An adhesive tank in which the adhesive is to be retained is movable, and the roller is provided with the adhesive tank, so that the adhesive is applied to the sheet stack via the roller. The adhesive tank and the roller are disposed at the stand-by position separated from the lower end face of the sheet stack to be coated in the stand-by stage, and are moved along a longitudinal direction of the sheet stack by an adhesive tank carrier in a bookbinding stage. The adhesive retained in the adhesive tank is heated by the non-contact heater, thus to be melted. The non-contact heater contactlessly heats the member contacting the adhesive such as the adhesive tank and the roller, so that the adhesive is heated though heat transfer. For example, a burner or an induction heater may be cited.

According to the bookbinding apparatus of the first aspect, since the adhesive tank can be contactlessly heated in the stand-by stage, the adhesive tank can be easily made movable, and since the adhesive tank moves during an application of the adhesive, the bookbinding apparatus can be made smaller in width. Also, since the adhesive tank moves in the longitudinal direction of the sheet stack, the roller can be made shorter, and therefore a capacity of the adhesive tank can be reduced. Consequently, diffusion of the smell of the adhesive from the adhesive tank can be suppressed.

A second aspect of the present invention provides the bookbinding apparatus according to the first aspect, wherein the non-contact heater is provided with an electromagnetic induction heating coil; and the adhesive tank is constituted of a material containing a ferromagnetic material.

The bookbinding apparatus according to the second aspect permits heating the adhesive without directly contacting the adhesive tank, thereby making it easier to design a carrying mechanism of the adhesive tank. Also, since heat control can be easily performed by adjusting a current to be supplied to the coil, a temperature of the adhesive can be easily controlled. Further, because of high heat exchanging efficiency of an induction heating coil, power consumption can be saved and the adhesive can be quickly heated.

A third aspect of the present invention provides the bookbinding apparatus according to the second aspect, wherein the non-contact heater is immovably placed at a stand-by position.

According to the bookbinding apparatus of the third aspect, the adhesive tank alone is moved while the non-contact heater stays at the fixed position; therefore wiring for the non-contact heater can be easily arranged. Here, even though the adhesive tank is not heated while the adhesive tank is moving, it does not create any problem for the bookbinding operation, because it is only when applying the adhesive to the sheet stack in a bookbinding stage that the adhesive tank moves, and such time is negligibly short.

A fourth aspect of the present invention provides the bookbinding apparatus according to the third aspect, wherein the adhesive tank is provided with a container-shaped main body of a non-ferromagnetic material for retaining therein the adhesive and a ferromagnetic heating portion located on an outer surface of the main body; and the non-contact heater is located so as to confront the heating portion of the adhesive tank placed at the stand-by position.

In the bookbinding apparatus according to the fourth aspect, the main body of the adhesive tank, which is indirect contact with the adhesive retained therein, is not directly heated by the coil. Therefore the adhesive can be prevented from being scorched because of overheating at an interface between the adhesive and the adhesive tank.

A fifth aspect of the present invention provides the bookbinding apparatus according to one of the second to fourth aspects, wherein the roller is constituted of a non-ferromagnetic material.

According to the bookbinding apparatus of the fifth aspect, since the roller which makes a direct contact with the adhesive is not directly heated by the non-contact heater, the adhesive can be prevented from being scorched at a contact area with the roller.

A sixth aspect of the present invention provides the bookbinding apparatus according to the first aspect, wherein the adhesive tank is provided with an inclined bottom wall in an adhesive retaining region of a container-shaped main body of the adhesive tank to retain the adhesive therein, for providing a deeper portion corresponding to a position of the roller.

According to the bookbinding apparatus of the sixth aspect, forming the deeper portion on the bottom wall of the adhesive tank corresponding to the position of the roller facilitates the adhesive to gather close to the roller so that the roller can be sufficiently dipped in the adhesive. Therefore, even though the adhesive in the adhesive tank has been consumed, the roller can still have a sufficient contact area with the adhesive.

A seventh aspect of the present invention provides the bookbinding apparatus according to the first aspect, wherein the adhesive tank is provided with a fin for promoting melting of the adhesive, erected on a bottom wall in the adhesive retaining region of the container-shaped main body of the adhesive tank to retain the adhesive therein.

According to the bookbinding apparatus of the seventh aspect, providing the fin increases the contact area between the adhesive and the adhesive tank, so that heat is applied to the adhesive via a more extensive area. Consequently, the adhesive can be melted more quickly.

An eighth aspect of the present invention provides the bookbinding apparatus according to one of the first to third aspects, further comprising an adhesive supply unit installed opposite to the stand-by position of the adhesive tank across the sheet stack, including a storing section for storing therein adhesive pellets to be transformed into the melted adhesive retained in the adhesive tank, a pellet supply path downwardly extending from a bottom portion of the storing section, and a pellet outlet through which the adhesive pellets transferred through the pellet supply path are discharged;

and an adhesive supply control unit for controlling a supplying timing of the adhesive pellets from the adhesive supply unit, such that a predetermined amount of adhesive pellets is discharged from the pellet outlet to the adhesive tank at a time that the adhesive tank has reached a position where the adhesive tank can receive the adhesive pellets discharged from the pellet outlet, so that the adhesive pellets supplied into the adhesive tank are melted.

According to the bookbinding apparatus of the eighth aspect, since a pellet type adhesive is employed and the gravity is utilized to supply the pellets through the supply path, a carrying mechanism is not required and therefore the adhesive supply unit can be constituted in a small scale. Also diffusion of smell due to melting the adhesive can be prevented. Further, since the adhesive is supplied when the adhesive tank has moved, the adhesive supply unit can be installed separately from the stand-by position, which is also a heating position, of the adhesive tank. Therefore, the respective units in the entirety of the bookbinding apparatus do not interfere with one another, and there is no likelihood that the adhesive pellets inside the adhesive supply unit are softened by the adhesive tank heated to a high temperature. Consequently, the bookbinding apparatus can be made smaller in dimensions as a whole.

A ninth aspect of the present invention provides the bookbinding apparatus according to the eighth aspect, further comprising a level detection unit for detecting a surface level of the adhesive retained in the adhesive tank; wherein the adhesive supply control unit supplies the adhesive pellets until the adhesive surface exceeds a reference level, when the adhesive surface level has been detected to be lower than the reference level by the level detection unit.

According to the bookbinding apparatus of the ninth aspect, since the adhesive is supplied at the time when a surface level of the adhesive retained in the adhesive tank has dropped because of consumption, an amount of the adhesive retained in the adhesive tank can be maintained at a constant level.

A tenth aspect of the present invention provides the bookbinding apparatus according to the eighth aspect, further comprising two openable partition plates disposed inside the supply path with a predetermined interval therebetween, so that a predetermined amount of adhesive pellets are stored between the partition plates; wherein the adhesive supply control unit open or close the two partition plates independently.

According to the bookbinding apparatus of the tenth aspect, the adhesive supply unit is provided with two partition plates disposed inside the supply path with an interval therebetween, so that the supply path can be opened or closed by manipulating the partition plates. In a region between the two partition plates a certain amount of adhesive pellets can be stored. Since the two partition plates can be independently opened or closed, a determined amount of adhesive can be supplied simply by discharging the adhesive pellets stored between the two partition plates.

An eleventh aspect of the present invention provides the bookbinding apparatus according to the tenth aspect, wherein each of the two partition plates is of a disk shape with an opening, and are fixed by a shaft disposed substantially parallel to the supply path such that a rotation phase of the opening of the respective partition plates is different from each other; and the adhesive supply control unit drives the shaft to rotate such that only one of the partition plates permits a communication through the supply path.

According to the bookbinding apparatus of the eleventh aspect, two disks provided with an opening such as a partial cutaway portion or a through hole, disposed in a mutually different rotation phase, are rotated by a single driving device, such that each partition plate can independently provide a path though the supply path. Therefore, a constitution of the adhesive supply unit can be simplified.

A twelfth aspect of the present invention provides an adhesive pellet of a substantially spherical shape, to be used with the adhesive supply unit usable with the bookbinding apparatus according to one of the eighth to eleventh aspects.

A thirteenth aspect of the present invention provides the bookbinding apparatus according to one of the first, second, third, fourth and eighth aspects, further comprising a binding mode selection unit for selecting a bookbinding mode according to a signal identifying whether a case binding mode of binding a sheet stack with a cover or a pad binding mode of binding a paper pad without a cover; and a rotation control unit for switching a roller controlling mode according to a bookbinding mode selected by the bookbinding mode selection unit.

The bookbinding apparatus according to the thirteenth aspect permits adjusting an amount of the adhesive to be applied when binding a sheet stack, according to whether or not a book is to be bound with a cover. More specifically, in case of case binding with a cover, the cover and the sheet stack have to be bonded, while in case of pad binding without a cover, only the paper sheets held by the holding unit have to be mutually bonded; therefore a different amount of adhesive is required. According to the bookbinding apparatus of this aspect, by adjusting an adhesive amount to be applied, according to whether or not the book is to be bound with a cover, a finish of the book can be upgraded.

A fourteenth aspect of the present invention provides the bookbinding apparatus according to the thirteenth aspect, wherein the adhesive tank carrier serves to move the adhesive tank and the roller back and forth in a longitudinal direction of the sheet stack; and the rotation control unit rotates the roller in a forward direction with respect to a moving direction thereof, during both of the forward and backward travels of the adhesive tank, when a pad binding mode in which a cover is not provided to the sheet stack is selected by the bookbinding mode selection unit.

According to the bookbinding apparatus of the fourteenth aspect, excessive application of the adhesive at a finishing point in a pad binding mode can be prevented by a simple control of the roller rotation.

A fifteenth aspect of the present invention provides the bookbinding apparatus according to the thirteenth aspect, wherein the adhesive tank carrier serves to move the adhesive tank and the roller back and forth in a longitudinal direction of the sheet stack; and the rotation control unit rotates the roller in a different direction according to a moving direction thereof.

According to the bookbinding apparatus of the fifteenth aspect, since a rotating direction of the roller is switched according to a moving direction thereof, a rotating direction of the roller remains unchanged during a travel in either direction. Therefore, uneven application of the adhesive can be prevented and a better finish can be achieved.

A sixteenth aspect of the present invention provides the bookbinding apparatus according to the fifteenth aspect, further comprising a thickness detecting device for detecting a thickness of the sheet stack held by the holding unit; wherein the rotation control unit stops a rotation of the roller during a forward travel of the adhesive tank but rotates the roller in a reverse direction with respect to the moving direction during a backward travel when a thickness of the sheet stack has been detected to be equal to or thinner than a reference thickness, while the rotation control unit rotates the roller in a forward direction with respect to a moving direction thereof during both of the forward and backward travels of the adhesive tank, when a thickness of the sheet stack has been detected to be thicker than the reference thickness, in case where the case binding mode of providing a cover to the sheet stack is selected by the bookbinding mode selection unit.

In case of the case binding, a finish of a book largely depends on an amount of applied adhesive, because the cover and the sheet stack may fall apart or the adhesive may be squeezed out of a joint area, unless an appropriate amount of adhesive is applied. When the sheet stack is thinner than a reference thickness, a smaller amount of adhesive tends to be applied; therefore the roller is made to rotate so that a larger amount of adhesive can be applied. Specifically, during a forward travel the roller is stopped so that less adhesive is applied. On the other hand, during a backward travel the roller is made to rotate in a reverse direction with respect to a moving direction thereof, in order to finally apply the adhesive to the back of the sheet stack. In other words, the roller moves in an opposite direction to a direction normally caused by the rotation. Such rotation of the roller increases a relative speed between the sheet stack and a contact surface of the roller, thereby causing the adhesive stuck to the roller surface to be scraped off toward the back of the sheet stack, and resultantly a larger amount of adhesive is applied.

By contrast, when a thickness of the sheet stack exceeds a reference thickness, a larger amount of adhesive is often applied; therefore the roller has to rotate so as to prevent an excessive application of the adhesive. Specifically, in order to maintain a same applying condition, the rotating direction is switched so that the roller rotates toward an upstream side with respect to moving direction of the roller during both forward and backward travels. Such rotation of the roller reduces a relative speed between the sheet stack and a contact surface of the roller, thereby preventing an excessive application of the adhesive.

Consequently, according to the bookbinding apparatus of the sixteenth aspect, an appropriate amount of adhesive can be applied with a simple arrangement by rotating the roller in a different direction according to a moving direction thereof, in the case binding mode.

A seventeenth aspect of the present invention provides the bookbinding apparatus according to the sixteenth aspect, wherein the reference thickness is in a range of 1.8 to 2.2 mm.

An eighteenth aspect of the present invention provides the bookbinding apparatus according to one of the thirteenth to sixteenth aspects, further comprising a position detection unit for detecting a position of the adhesive tank, wherein, once the adhesive tank reaches a predetermined position during a backward travel, the rotation control unit stops the rotation of the roller during the subsequent travel of the adhesive tank from the predetermined position to a final edge of the sheet stack.

Referring to the bookbinding apparatus according to the present invention, a large amount of adhesive is prone to stick to an end portion of the sheet stack, because the adhesive on the roller surface is scraped off by a lateral edge at both ends of the sheet stack. Especially in case of case binding with a cover, an excessive amount of adhesive stuck to end portion of the sheet stack produces a protrusion of solidified adhesive, resulting in a defective finish of the book. Therefore, it is desirable to prevent deposition of a large amount of adhesive at both edges of the sheet stack.

For this purpose, the adhesive tank is moved with the roller stopped, in the proximity of a final edge of the sheet stack. By such arrangement, the adhesive is no longer supplied from the adhesive tank, and the adhesive remaining on the roller surface is spread over in a region close to the edge of the sheet stack. Consequently, deposition of an excessive amount of adhesive in the proximity of a final edge of the sheet stack can be prevented.

Also, a reason that the roller is stopped only in a backward travel in the foregoing constitution is that surplus adhesive stuck to the end portion in a forward travel can be removed by the roller on its way back, while surplus adhesive on the end portion in the backward travel (the final end) cannot be thus removed by the roller. Accordingly, the above constitution permits easily removing the excessive adhesive by changing an applying condition via the roller.

Consequently, according to the bookbinding apparatus of the eighteenth aspect, by moving the adhesive tank with the roller stopped in the proximity of an edge of the sheet stack, where an excessive amount adhesive is prone to stick, the adhesive is no longer supplied from the adhesive tank, and the adhesive remaining on the roller surface is applied so as to be spread over. Consequently, deposition of an excessive amount of adhesive in the proximity of a final edge of the sheet stack can be prevented.

BRIEF DESCRIPTION OF THE DRAWINGS

These and other aspects and features of the present invention will become clear from the following description taken in conjunction with the preferred embodiments thereof with reference to the accompanying drawings, in which.

BEST MODE FOR CARRYING OUT THE INVENTION

Figure 1:
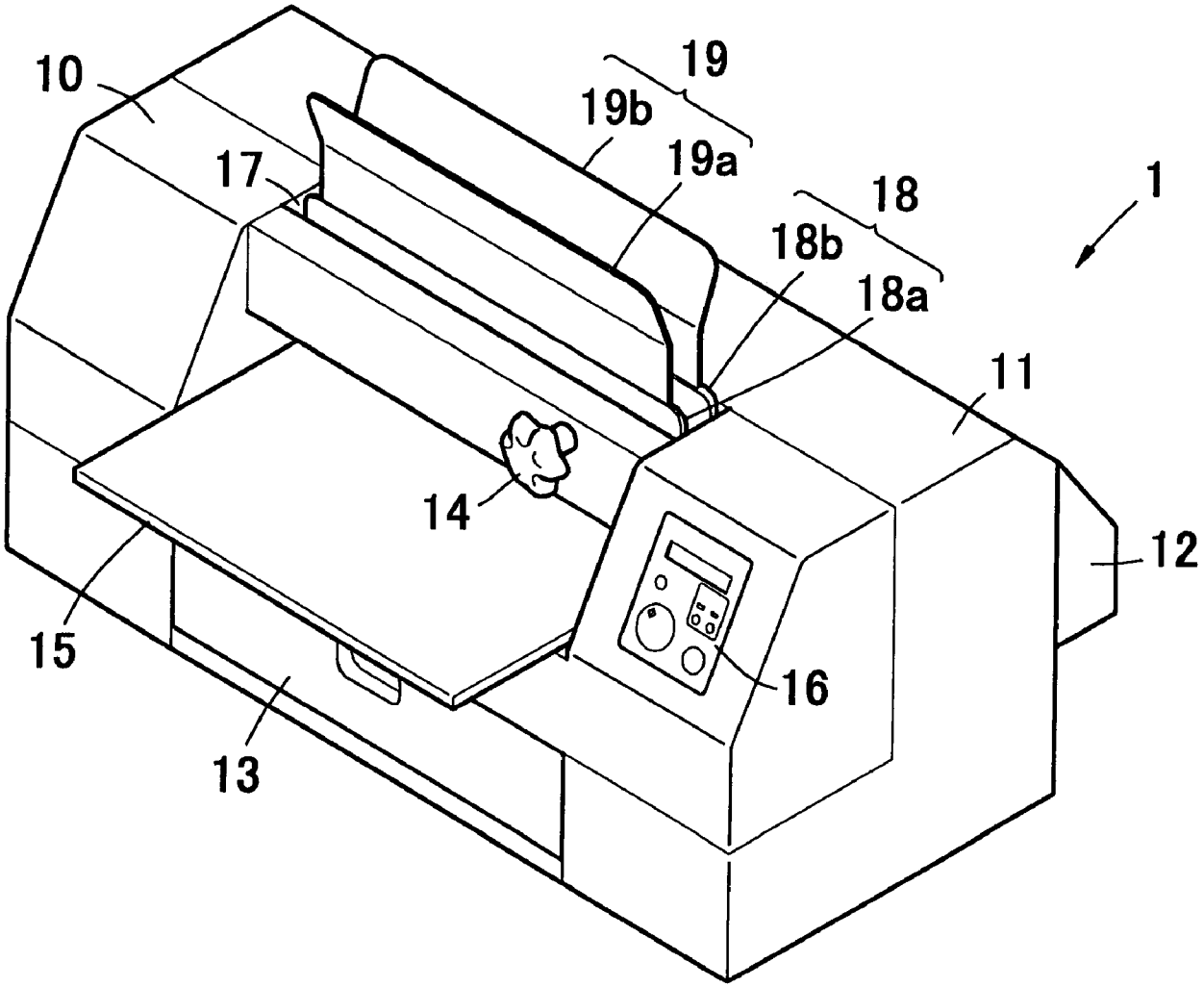
FIG. 1 is a perspective view showing an outer appearance of a bookbinding apparatus according to an embodiment of the present invention.

Before the description of the present invention proceeds, it is to be noted that like parts are designated by like reference numerals throughout the accompanying drawings.

Figure 7:
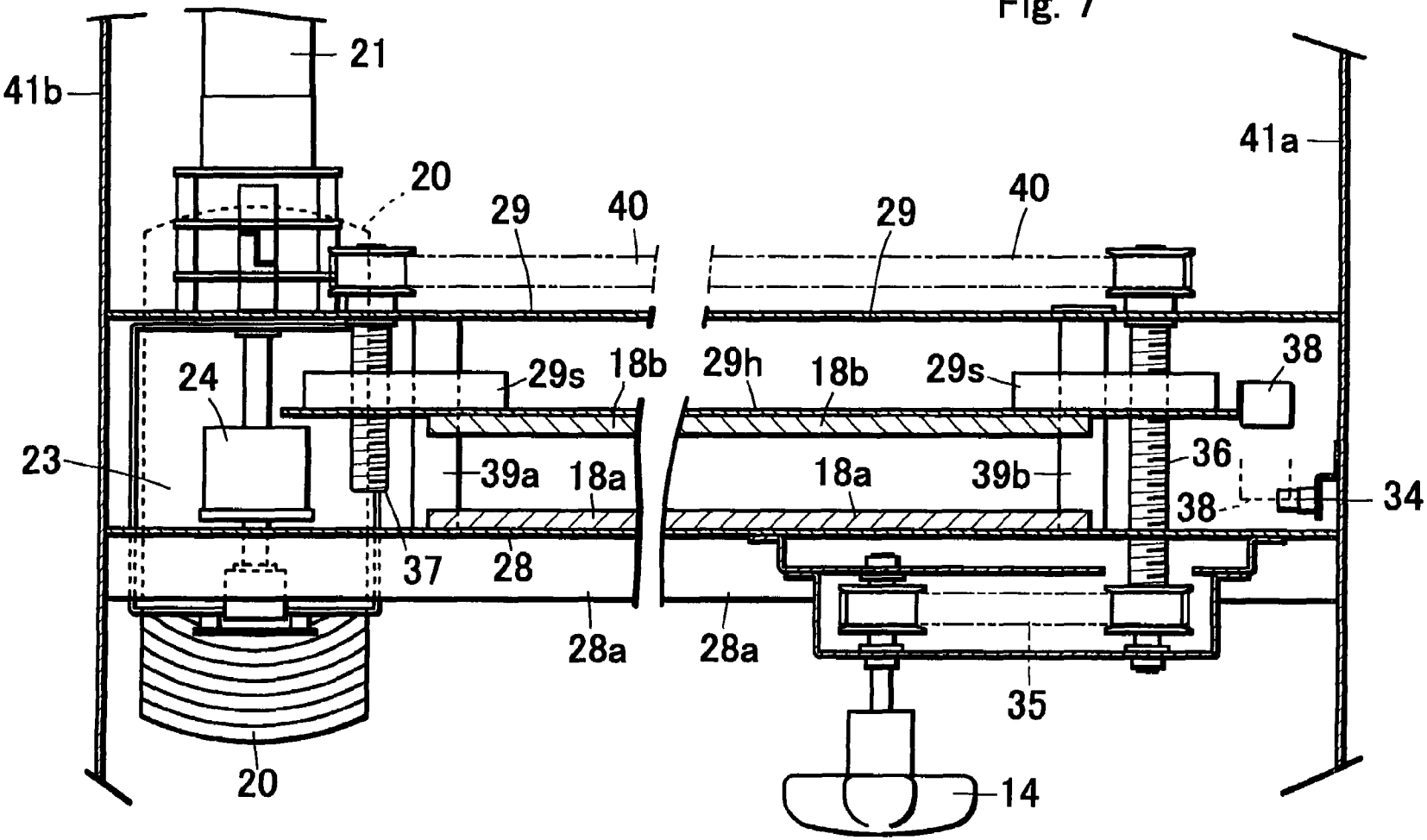
FIG. 7 is a view for explaining a clamp operating mechanism.
Figure 20A:
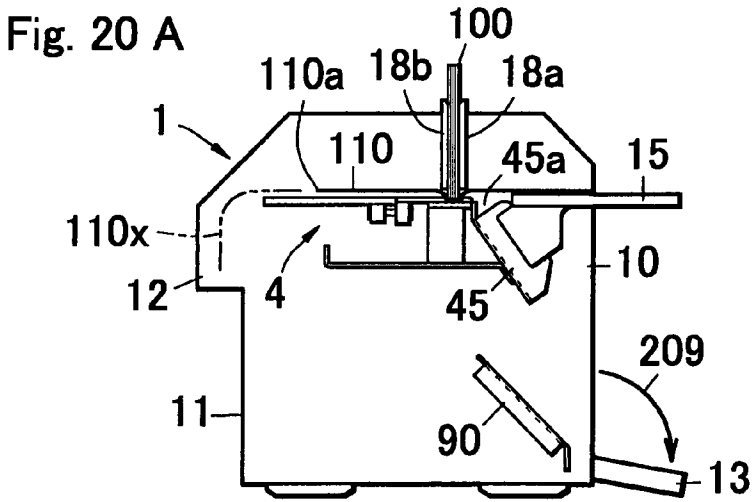
FIGS. 20A, 20B, 20C and 20D are views progressively showing a book discharging process.
Figure 20B:
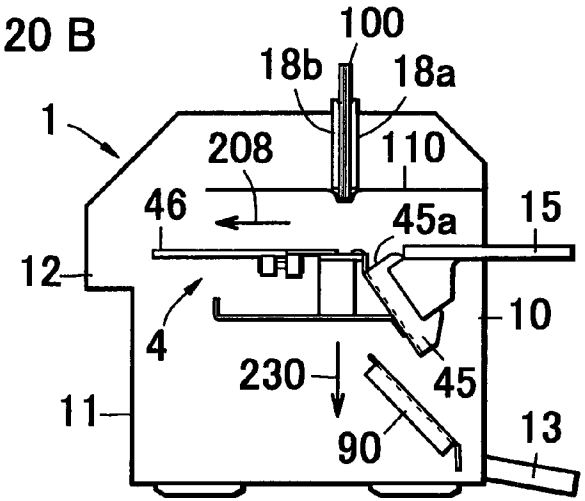
Figure 20C:
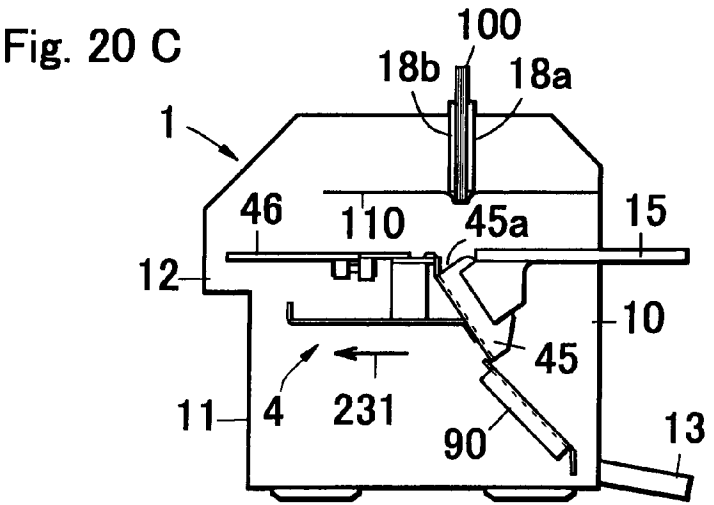

FIG. 1 is a perspective view showing an outer appearance of a bookbinding apparatus according to an embodiment of the present invention. The bookbinding apparatus 1 is a generally box-shaped apparatus, provided with a casing including a front housing 10 constituting a front and an upper face of a main body, and a rear housing 11 constituting a rear and an upper face thereof. The front housing 10 and the rear housing 11 are fixed to a frame 28, 29, 41*a* and 41*b* (Ref. FIG. 7) provided inside the main body, as will be described later. The rear housing 11 is provided with a rear cover 12 on a rear face thereof, which has an inclined wall for securing an additional space for a cover for bookbinding (110*x* of FIG. 20A) and a movable plate 46, and for bending the cover 110*x* downward to retain temporarily (Ref. FIGS. 20A and 20C).

As an outer structure, the bookbinding apparatus 1 is provided with a lower front door 13 openably installed below the front housing 10, an operating knob 14 for opening or closing a clamp unit 18 which holds a sheet stack when in operation, a cover tray 15 for placing thereon a cover for bookbinding, and an operating panel 16.

Also, the clamp unit 18 is installed on an upper face of the main body. The clamp unit 18 is constituted of a pair of generally rectangular plates, a fixed clamp 18*a* and a movable clamp 18*b*, disposed parallel to each other in a perpendicular direction, so as to partly protrude upwardly through a gap 17 provided on an upper face of the main body. As already stated, by manipulating the operating knob 14 the movable clamp 18*b* is moved so as to vary an interval between the clamps, for fixing or releasing the sheet stack. At an upper end potion of the clamps 18*a* and 18*b*, sheet stack supporters 19*a* and 19*b* are detachably attached respectively, for preventing a portion of the sheet stack projecting above the clamp unit 18 from downwardly bending to thereby cause misalignment of the papers, when binding a vertically lengthy sheet stack.

Figure 2:
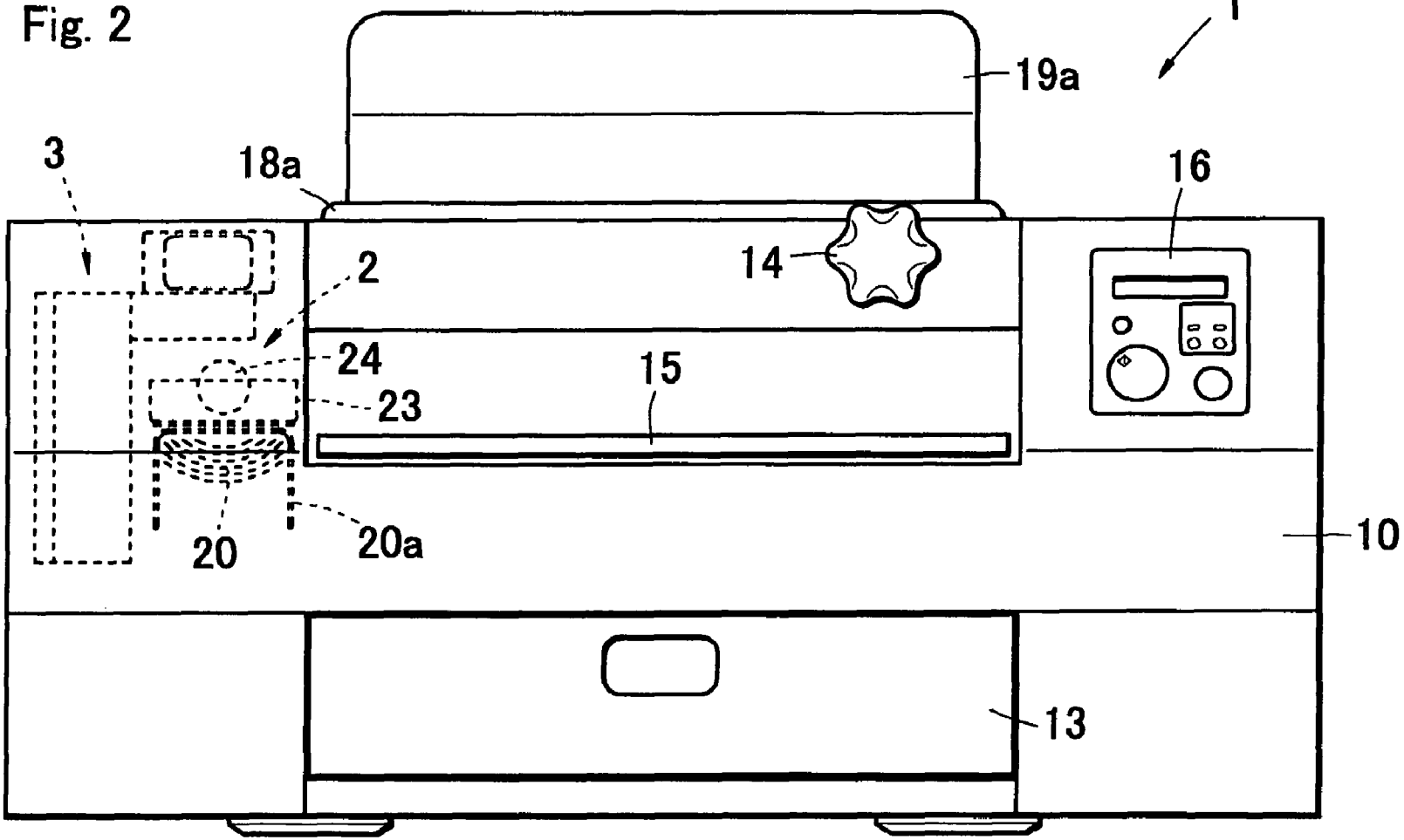
FIG. 2 is a front view showing a part of inner structures of the bookbinding apparatus of FIG. 1.
Figure 3:
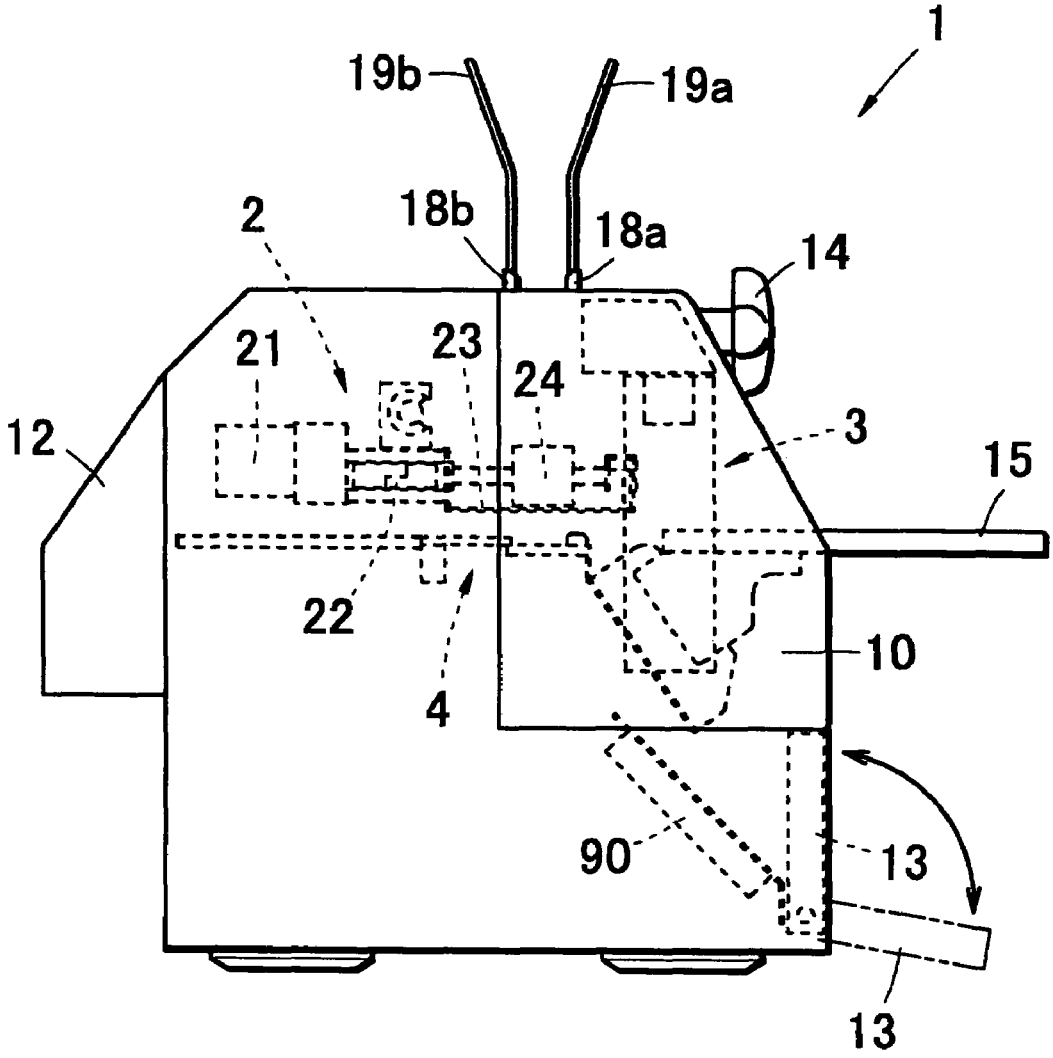
FIG. 3 is a left side view showing a part of inner structures of the bookbinding apparatus of FIG. 1.
Figure 8:
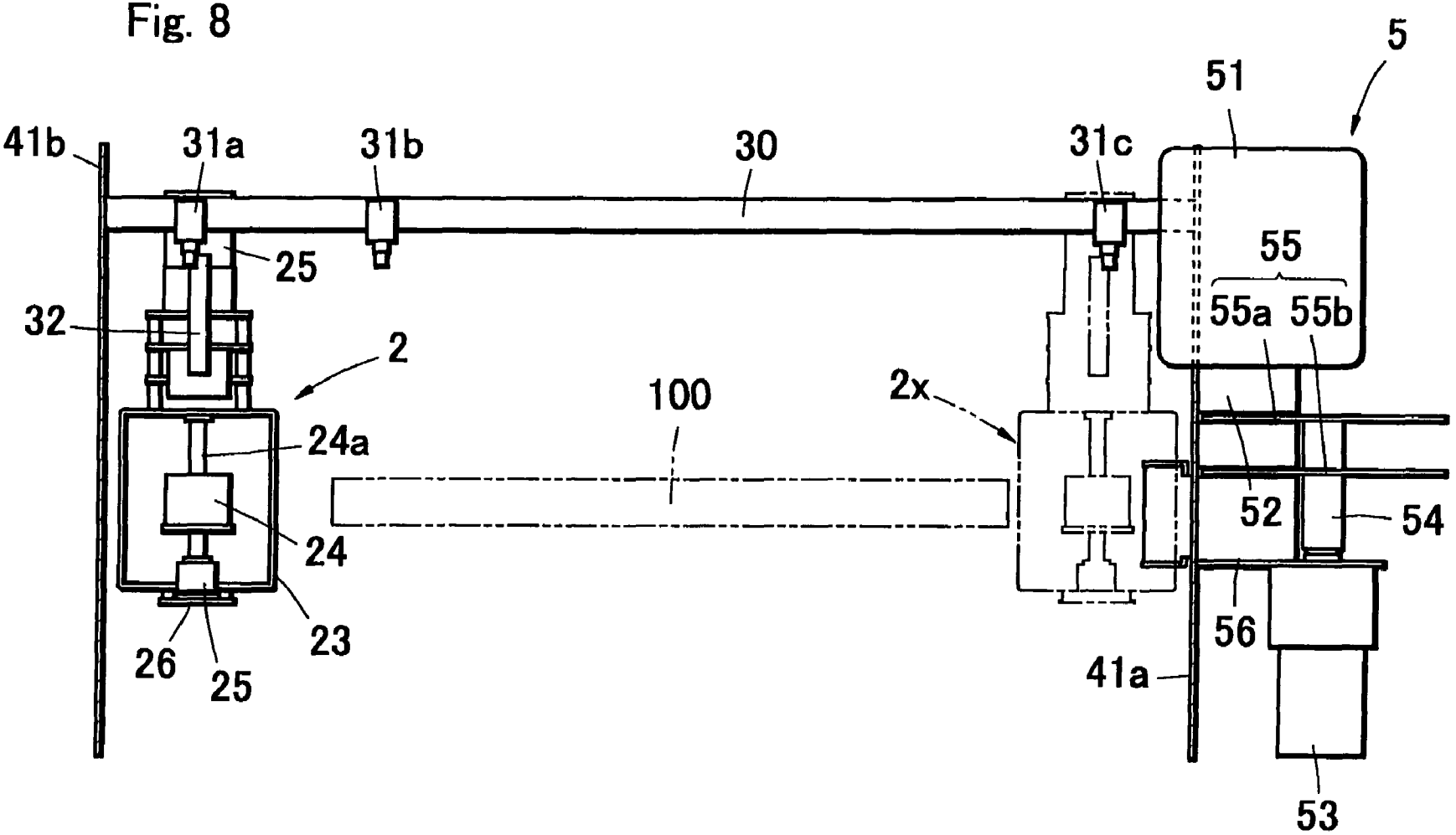
FIG. 8 is a view showing a travel of an adhesive tank.

Inside the main body, various units such as an application unit 2, a deodorizing unit 3, a pressing unit 4 and an adhesive supply unit 5 are installed, as shown in FIGS. 2, 3 and 8. As shown in FIG. 2, the application unit 2 is usually disposed at an outer position from a lateral edge of the clamp unit 18, and a portion of the application unit 2 is designed to slide along a lower end of the clamp unit 18, as described later.

The deodorizing unit 3 is disposed so as to extend downwardly from a position above the application unit 2 as shown in FIGS. 2 and 3, for aspiring adhesive vapor that has volatilized from an adhesive tank 23 and a roller 24 of the application unit 2, so that a built-in filter adsorbs the vapor.

The pressing unit 4 is disposed under the clamp unit 18 as shown in FIG. 3, and is designed to move forward and backward, as well as upward and downward as described later. When the application unit 2 moves, the pressing unit 4 is lowered so that the application unit 2 can pass under the clamp unit 18.

Figure 4:
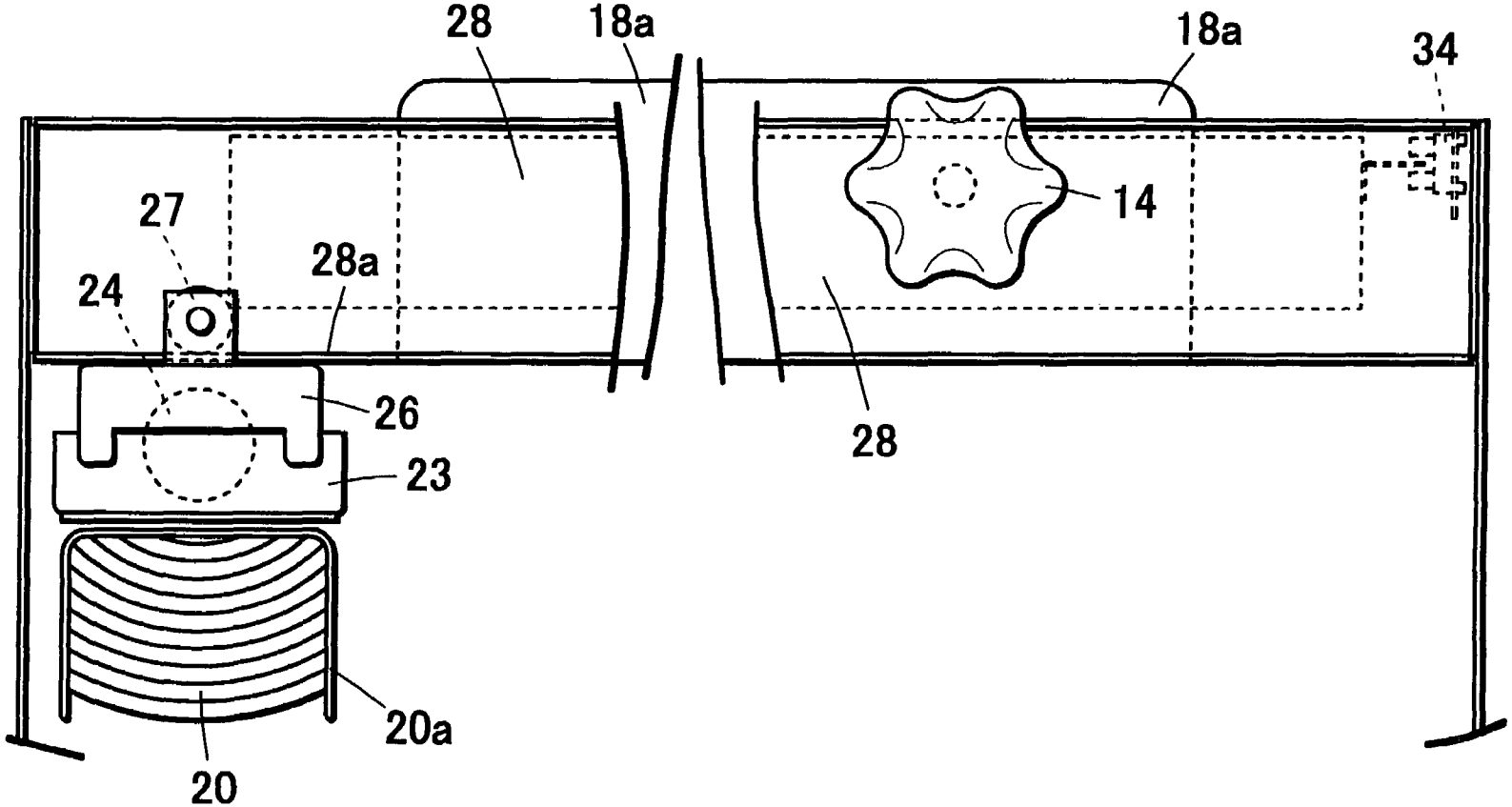
FIG. 4 is a front view showing a layout of units with an application unit set at a stand-by position.
Figure 5:
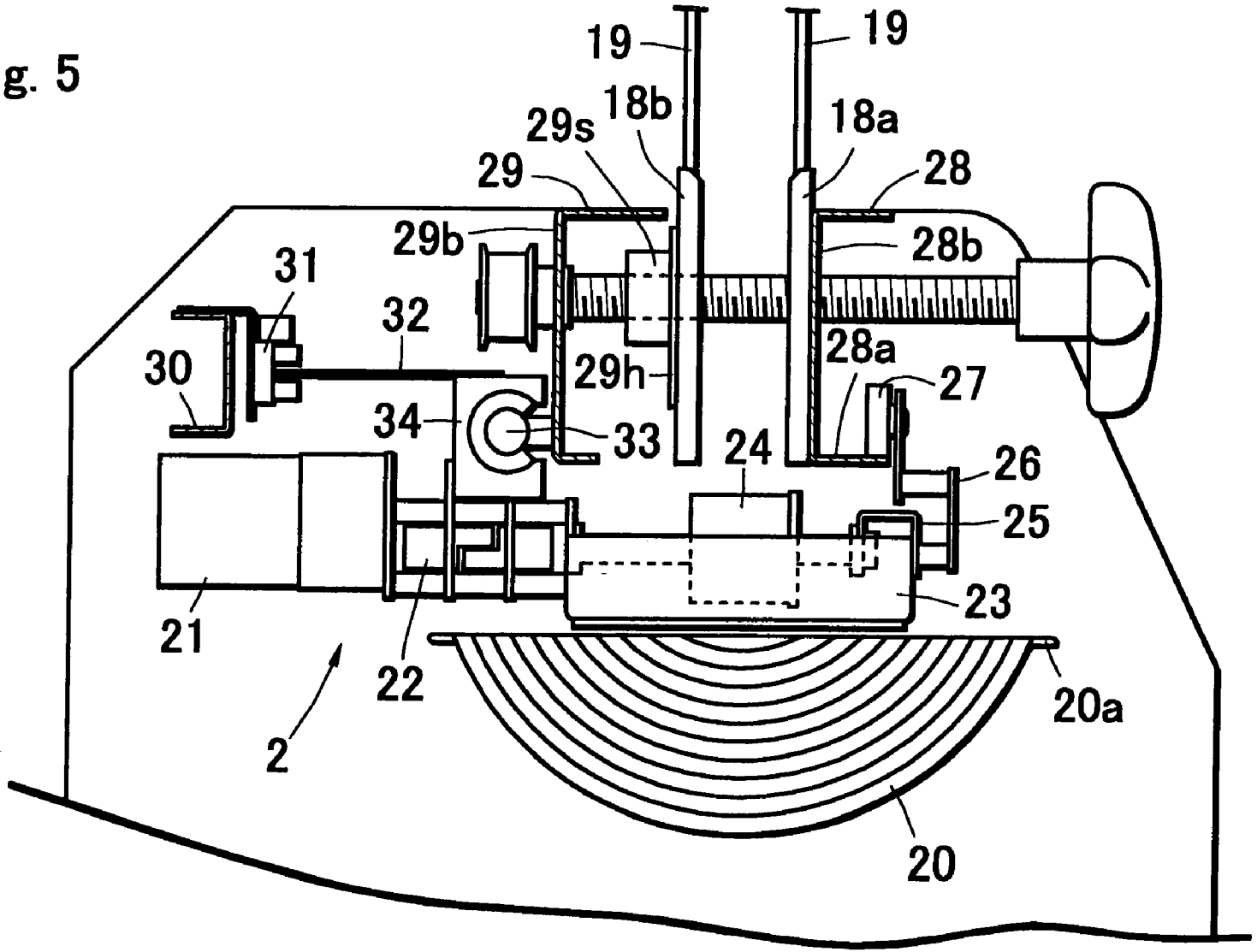
FIG. 5 is a left side view showing a layout of units with the application unit set at the stand-by position.

FIGS. 4 and 5 are drawings showing a layout of the units with the application unit 2 set at a stand-by position. The application unit 2 and the clamp unit 18 are both installed on two frames 28 and 29. The front frame 28 has a [-shaped cross section, and sustains the fixed clamp 18*a* on its vertical portion 28*b*, while a horizontal portion 28*a* serves as a rail for the adhesive tank 23 to slide thereon. The rear frame 29 also has a [-shaped cross section, and is provided with a moving mechanism for moving the movable clamp 18*b*. Also, the rear frame 29 sustains a rail shaft 33, which serves as a guide for a travel of the adhesive tank, on its vertical portion 29*b*.

The application unit 2 is disposed at an outer position from a lateral edge of the clamp unit 18 and at a lower position from a lower edge thereof. The application unit 2 is provided with an induction coil 20 attached to a base plate 20*a*, which serves as a heater, so as to heat the adhesive without contacting with the adhesive tank 23 by induction heating of a ferromagnetic material, when the adhesive tank is at the stand-by position.

Above the adhesive tank 23, the roller 24 is disposed so as to dip a portion thereof in the melted adhesive. The roller 24 is ratatably supported by a supporter 25, and is made to rotate by a roller rotating motor 21 via a shaft 22.

The adhesive tank 23 is provided with a coupling unit 26 extending upwardly from an end portion thereof, and a roller 27 attached at an end portion of the coupling unit 26 is engaged with the rail, constituted of the horizontal portion 28*a* of the front frame 28. Also, a guide member 34 is attached at the other end portion of the adhesive tank 23, which is engaged with the rail shaft 33 provided on the vertical portion 29*b* of the rear frame 29. These two engagements permit the adhesive tank 23 to slide along the frames 28 and 29, to thereby move under and along the clamp unit 18 attached to the frames 28 and 29.

Now referring to FIG. 7, an operation mechanism of the clamp unit 18 will be described. As already mentioned, the fixed clamp 18*a* is attached to the front frame 28, and an operation mechanism of the movable clamp 18*b* is located on the rear frame 29. The movable clamp 18*b* can be moved so as to vary an interval from the fixed clamp 18*a*, by manipulating the operating knob 14, for the purpose of holding the sheet stack between the clamps.

When rotating the operation knob 14, a threaded shaft 36, connected thereto via a shaft of the operating knob 14 and a belt 35, is caused to rotate. A rotating force of the threaded shaft 36 is transmitted to another threaded shaft 37 via a belt 40, thereby interlocking the rotation of the both threaded shafts. The threaded shafts 36 and 37 are engaged with a threaded hole 29*s* on a back-up plate 29*h* to which the movable clamp 18*b* is fixed; therefore a rotation of the threaded shafts 36 and 37 causes the movable clamp 18*b* to move together with the back-up plate 29*h*.

Between the fixed clamp 18*a* and the movable clamp 18*b*, guide shafts 39*a* and 39*b* are provided, so that the movable clamp 18*b* is constantly maintained parallel to the fixed clamp 18*a* because of moving along the guide shafts 39*a* and 39*b*. Meanwhile, the guide shaft 39*a*, located on the left when viewed from a forward direction of the bookbinding apparatus 1, serves as a positioning reference in a longitudinal direction for the sheet stack as described later, to thereby determine a holding position of the sheet stack in cooperation with the fixed clamp 18*a*, which serves as a reference in a thicknesswise direction.

The back-up plate 29*h* is provided with a detection piece 38 attached at an end portion thereof. The detection piece 38 cooperates with the sheet stack thickness sensor 34 constituted of a photointerrupter, to detect whether a sheet stack is thinner than a predetermined reference thickness. Specifically, in case where a sheet stack held by the clamp unit 18 is thicker than the reference thickness, the detection piece 38 does not reach the sheet stack thickness sensor 34 and hence does not interrupt the sheet stack thickness sensor 34, however when the sheet stack is thinner than the reference thickness the movable clamp 18*b* comes closer to the fixed clamp 18*a*, thereby causing the detection piece 38 to interrupt the sheet stack thickness sensor 34. An information of a thickness of the sheet stack is used as an index to determine a rotating direction of the roller 24 when applying the adhesive, as described later.

FIG. 8 is a drawing showing a travel of an adhesive tank. As already mentioned, the adhesive tank 23 is designed so as to slide in such a state that the adhesive stuck to a surface of the roller 24 is in contact with a lower end face of the sheet stack 100 held by the clamp unit 18. In order to detect a position of the adhesive tank 23, sensors 31*a*, 31*b* and 31*c* constituted of a photointerrupter are provided. In the bookbinding apparatus 1 according to this embodiment, the sensors 31*a*, 31*b* and 31*c* are disposed on a sensor supporting frame 30 fixed between a right frame 41*a* and left frame 41*b* both fixing the front frame 28 and the rear frame 29. The sensors are respectively defined as a first position sensor 31*a* for detecting the adhesive tank 23 at the stand-by position, a third position sensor 31*c* for detecting the adhesive tank at a farthest position of the travel, and a second position sensor 31*b* located in the middle of the other sensors. These sensors detect a position of the adhesive tank 23 each time a detection piece 32 attached to the adhesive tank 23 interrupts the respective sensors while the adhesive tank 23 is moving.

Also, as shown by a dotted line 2*x* in FIG. 8, the adhesive supply unit 5 for replenishing the adhesive tank with the adhesive is installed at a position corresponding to the farthest travel position of the adhesive tank 23. The adhesive supply unit 5 stores adhesive pellets in a hopper 51, to supply a predetermined amount of adhesive in the adhesive tank 23 at an appropriate timing.

Figure 9A:
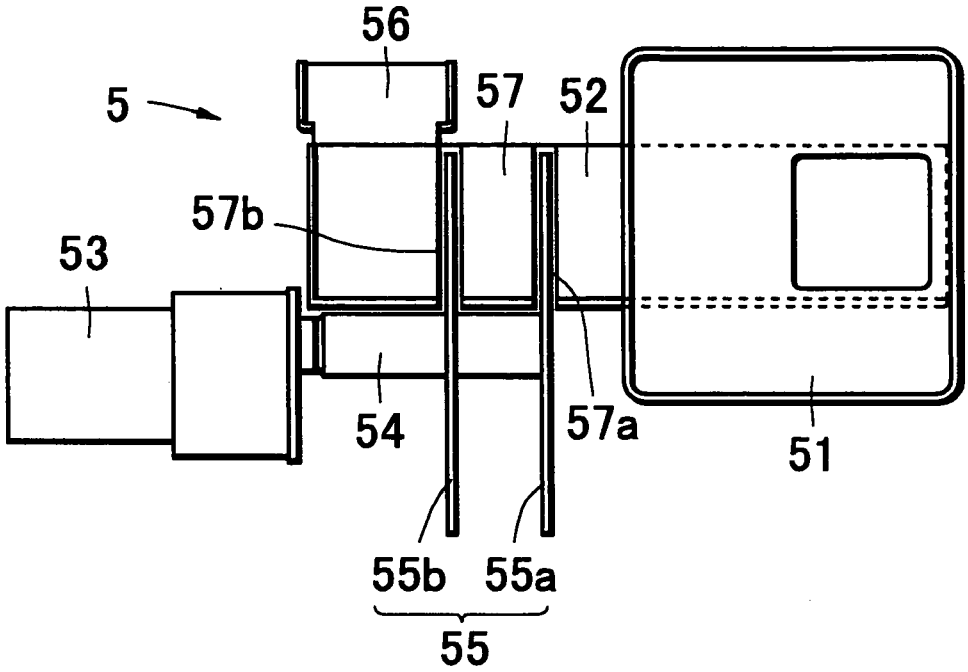
FIG. 9A is a plan view showing a constitution of an adhesive supply unit.
Figure 9B:
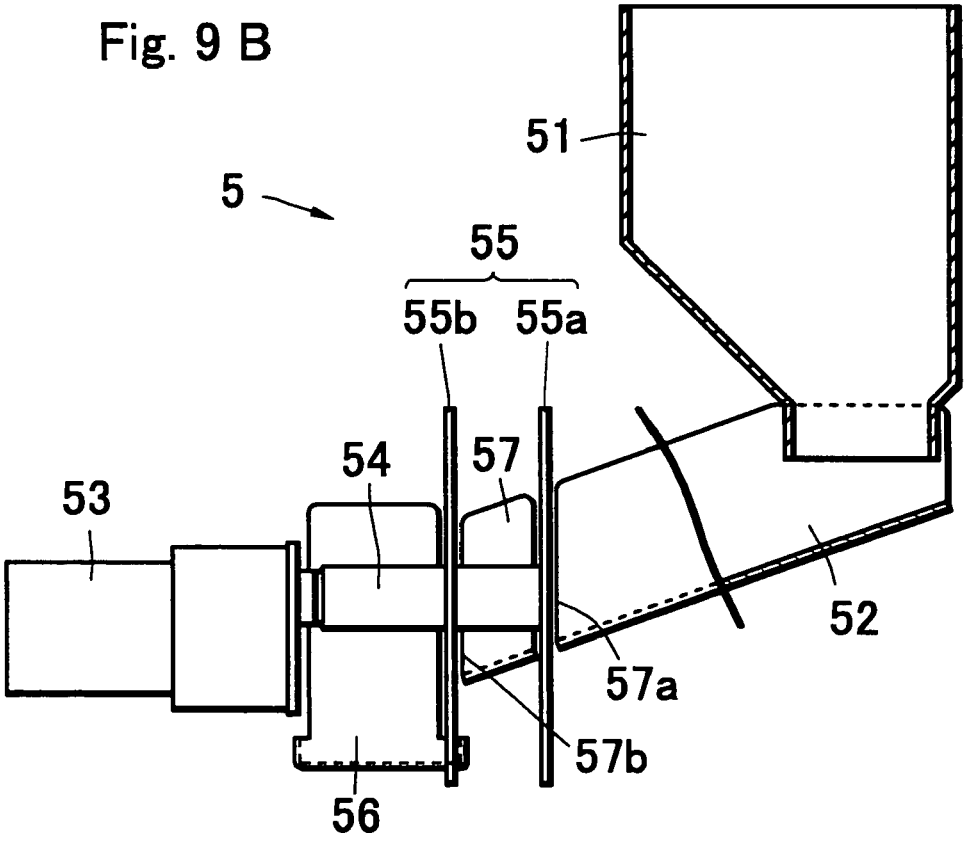
FIG. 9B is a right side view showing a constitution of the adhesive supply unit.

FIGS. 9A and 9B are drawings showing a constitution of the adhesive supply unit 5. The adhesive supply unit 5 includes the hopper 51 for storing therein the adhesive pellets, a downwardly inclined duct 52 connected to a lower portion of the hopper 51 and an outlet 56 through which the adhesive is to be supplied to the adhesive tank 23. The duct 52 is provided with two partition grooves 57*a* and 57*b*, and partition plates 55 are placed in the respective partition grooves 57*a* and 57*b*. The partition plates 55 are respectively defined as a first partition plate 55*a* which is closer to the hopper 51, and a second partition plate 55*b* which is farther. The first partition plate 55*a* and the second partition plate 55*b* are of a disk shape with a partial cutaway portion, disposed mutually parallel in a shifted rotation phase so that the cutaway portions to not overlap, and are fixed to a shaft 54 at a central portion of the disks. The shaft 54 is connected to a partition plate driving motor 53, so that the first partition plate 55*a* and the second partition plate 55*b* rotate together when the motor 53 is activated.

The adhesive supply unit 5 rotates the shaft 54 by a predetermined angle so as to control a rotational position of the first partition plate 55*a* and the second partition plate 55*b*, such that the adhesive pellets stored in the hopper 51 is supplied to the adhesive tank 23, in a lot of a predetermined amount each time.

Figure 10A:
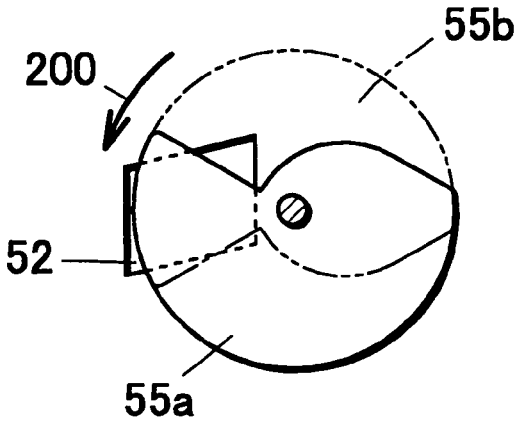
FIGS. 10A, 10B, 10C, 10D, 10E, 10F, 10G, and 10H are schematic views for explaining an operating process of the adhesive supply unit.
Figure 10B:
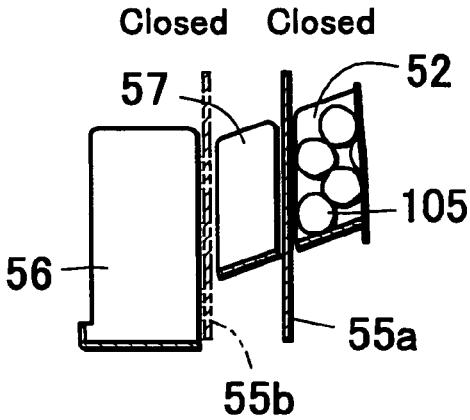

FIGS. 10A to 10H are schematic drawings for explaining an operating process of the adhesive supply unit. Initially, the two partition plates, the first partition plate 55*a* and the second partition plate 55*b*, are disposed so as to respectively close an opening of the duct 52, as shown in FIGS. 10A and 10B. Accordingly, the adhesive pellets 105 stored in the hopper 51 are located on an upstream side of the first partition plate 55*a*.

Figure 10C:
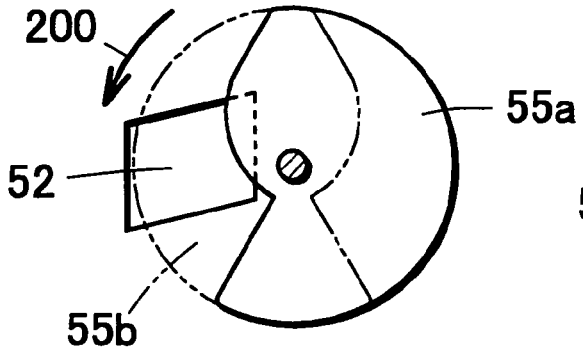
Figure 10D:
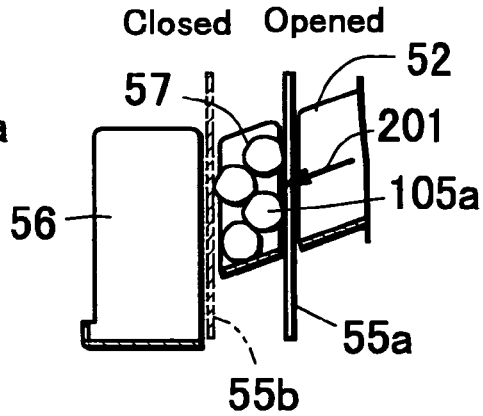

When the first partition plate 55*a* and the second partition plate 55*b* rotate by 90 degrees around the rotation center 54*c* in a direction of the arrow 200, the situation turns to a state shown in FIGS. 10C and 10D. In this state, the cutaway portion of the first partition plate 55*a* overlaps the opening to provide a path; therefore the adhesive pellets 105 move to an intermediate duct 57 as indicated by the arrow 201. Yet, the adhesive pellets cannot move further downstream since the second partition plate 55*b* is covering the opening, in this state.

Figure 10E:
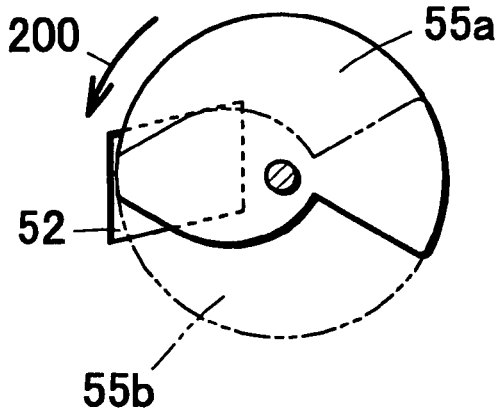
Figure 10F:
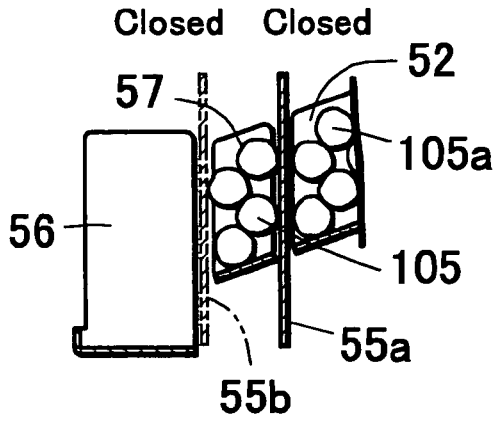

When the first partition plate 55*a* and the second partition plate 55*b* rotate by another 90 degrees around the rotation center 54*c* in a direction of the arrow 200, the situation turns to a state shown in FIGS. 10E and 10F. In this state, since both of the first partition plate 55*a* and the second partition plate 55*b* are covering the openings, the adhesive pellets exist both in the intermediate duct 57 and on an upstream side of the first partition plate 55*a* in the duct 52. However, the adhesive pellets 105*a* in the intermediate duct 57 are isolated by the first partition plate 55*a* from the adhesive pellets 105*b* on an upstream side.

Figure 10G:
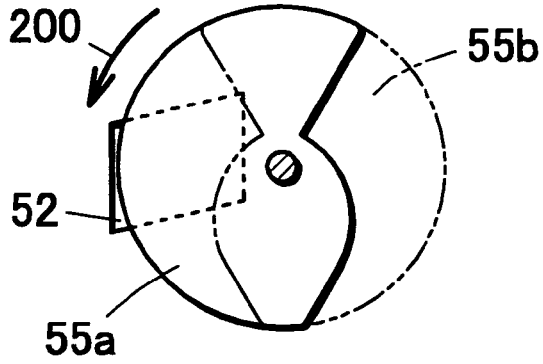
Figure 10H:
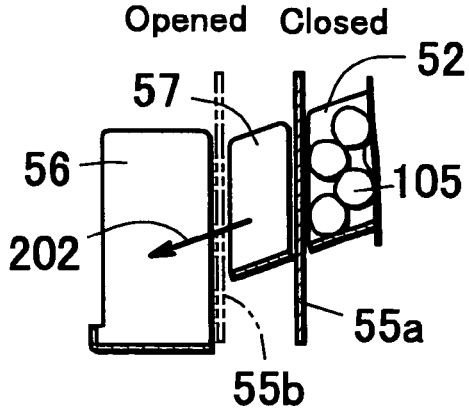

Again, when the first partition plate 55*a* and the second partition plate 55*b* rotate by another 90 degrees around the rotation center 54*c* in a direction of the arrow 200, the situation turns to a state shown in FIGS. 10G and 10H. In this state, the cutaway portion of the second partition plate 55*b* overlaps the opening to provide a path, so that the adhesive pellets 105*a* in the intermediate duct 57 move toward the outlet 56 as indicated by the arrow 202. Also, since the first partition plate 55*a* is still covering the opening, the adhesive pellets 105 in the duct 52 cannot move forward. Therefore, only the adhesive pellets 105*a* in the intermediate hopper 57 can move to the outlet 56. Consequently, by adjusting a capacity of the intermediate duct 57 so as to match a desired replenishing amount, an appropriate amount of adhesive pellets can be automatically supplied to the adhesive tank 23.

Figure 11A:
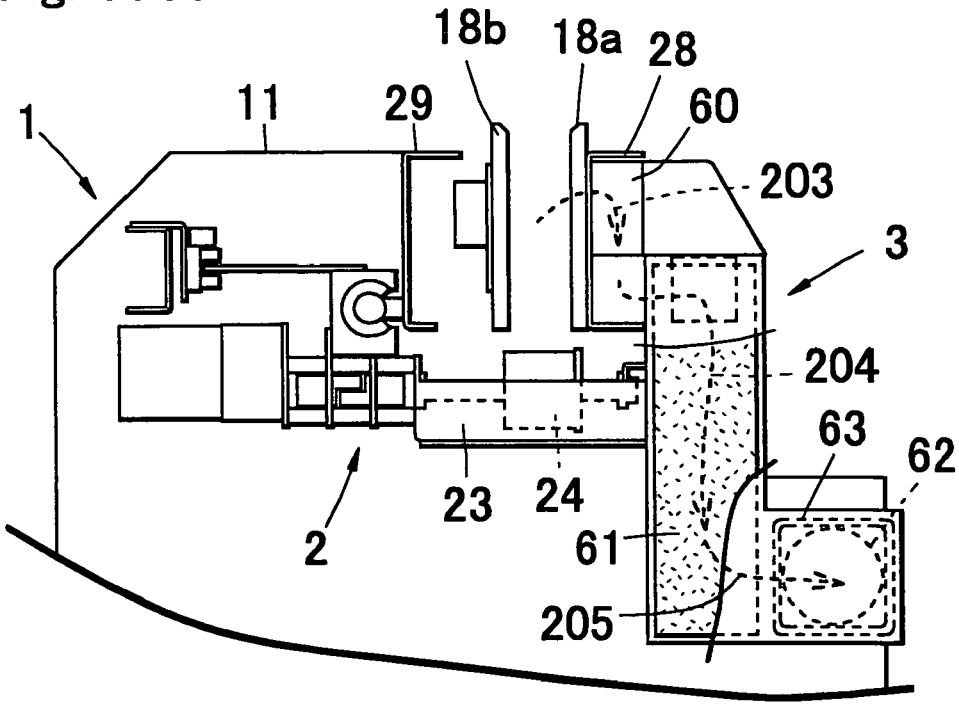
FIG. 11A is a fragmentary left side view showing a layout related to a deodorizing unit.
Figure 11B:
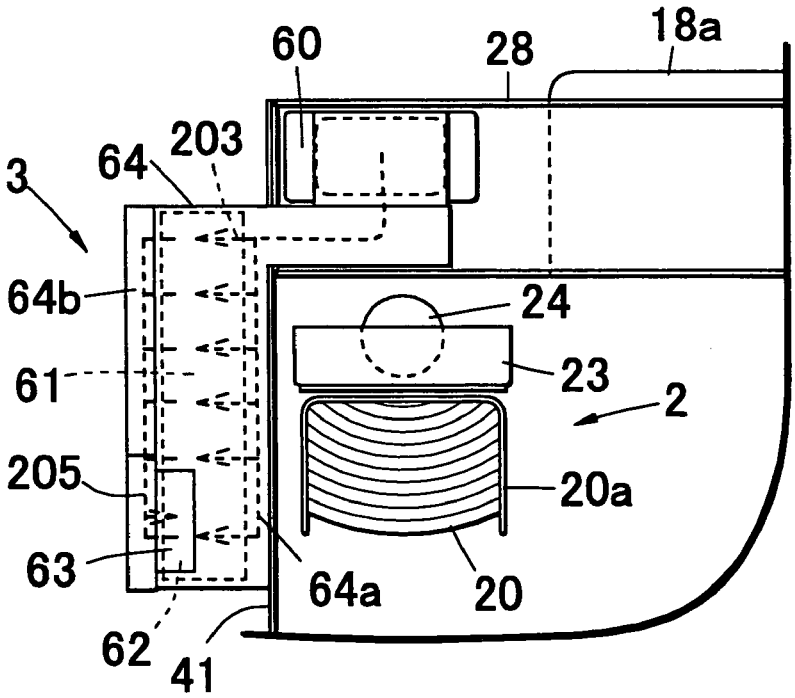
FIG. 11B is a fragmentary front view showing a layout related to the deodorizing unit.

Now the deodorizing unit 3 will be described. As already mentioned, the deodorizing unit 3 serves to aspire the adhesive vapor that has volatilized from the adhesive tank 23 and the roller 24 of the application unit 2, so that a filter adsorbs the vapor. Specifically, the deodorizing unit 3 is constituted of a cylinder provided with a suction port 60 and a discharge port 63, and a filter 61 is located in a duct 64 which constitutes a middle portion of the cylinder as shown FIGS. 11A and 11B. A known filter that can adsorb ingredients of the adhesive may be employed as the filter 61.

A ventilating fan 62 is provided in the proximity of the discharge port 63, and is discharging air outwardly through the discharge port 63. Accordingly, air is aspired through the suction port 60, and passes through the filter 61 to be discharged through the discharge port 63. The suction port 60 is disposed with the adhesive tank 23 and the roller 24, in order to aspire air containing the ingredients of the adhesive that have volatilized from the adhesive tank 23 and the roller 24. The air aspired through the suction port 60 flows through a gap 64*a* provided in the duct 64 and passes from a front face of the filter 61 to a rear face thereof, during which the ingredients of the adhesive are adsorbed and removed. The air then reaches another gap 64*b* located opposite to the gap 64*a* across the filter 61, and proceeds to the discharge port 63 because of a suction force of the ventilating fan 62, to be finally discharged through the discharge port 63. Therefore, the discharged air only contains a reduced amount of adhesive ingredients, and consequently diffusion of smell due to heating the adhesive can be restrained.

Then a constitution of the adhesive tank 23 and the roller 24 will be described. Since the adhesive tank 23 is designed to heat the adhesive via the induction coil 20, the adhesive tank 23 has to at least partially include a ferromagnetic material. In the adhesive tank 23 according to this embodiment, a tray main body 23*a* is constituted of aluminum, which is highly thermoconductive and non-ferromagnetic, and a ferromagnetic heating plate 72 is provided at a bottom portion of the tray main body 23*a*. Also, a plurality of fins 70 is vertically formed on a bottom portion of an inner face of the tray main body 23*a*, to increase a contact area between the tray main body 23*a* and the adhesive. Because of such constitution, when heating the adhesive, heat produced by the heating plate 72 is conducted to the tray main body 23*a* made of aluminum, which is highly thermoconductive, to thereby efficiently heat the adhesive over an extensive area. Consequently, since the adhesive is uniformly heated without directly heating the tray main body 23*a*, overheating of a contact area between the adhesive and the tray main body 23*a*, and hence scorching of the adhesive, can be prevented.

Also, the tray main body 23*a* is formed in such a shape that a peripheral region is shallower while a central region above which the roller 24 is located is deepest. Such shape facilitates the adhesive to gather close to the roller 24 even when the adhesive in the adhesive tank 23 has been consumed, thereby permitting the roller 24 to be sufficiently dipped in the adhesive.

Further, the main body 23*a* of the adhesive tank 23 is provided with a pair of thermocouples 71*a* and 71*b*, by which a temperature of the adhesive can be measured. Among the pair of thermocouples 71*a* and 71*b*, one is a temperature detecting thermocouple 71*a* for measuring the adhesive temperature at a deep portion of the tray main body 23*a*. According to an output from the thermocouple 71*a*, power supply to the heating coil 20 is turned on and off so as to maintain an appropriate temperature for the adhesive being used.

Figure 14:
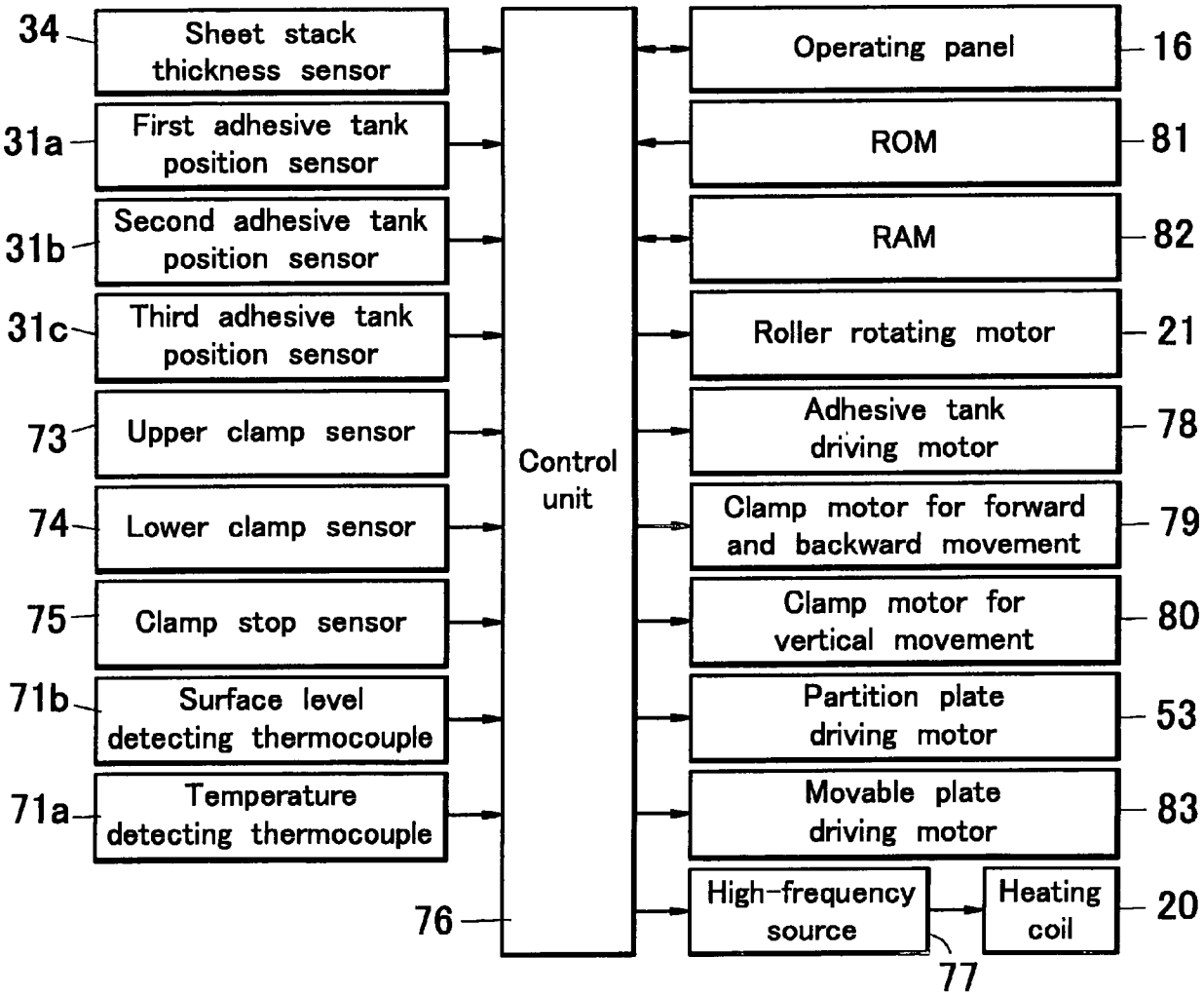
FIG. 14 is a block diagram showing a control system of the bookbinding apparatus according to the embodiment.

On the other hand, the other thermocouple is a surface level detecting thermocouple 71*b* for measuring the adhesive temperature at a shallow portion of the tray main body 23*a*. When the adhesive has been consumed a surface level of the adhesive drops lower than a position of the thermocouple 71*b*, by which the thermocouple 72*b* detects a temperature lower than a predetermined value, and transmits a signal to such effect to a control unit 76 (Ref. FIG. 14) including a CPU. The control unit, in receipt of the signal, operates the adhesive supply unit 5 to refill the adhesive.

Figure 12A:
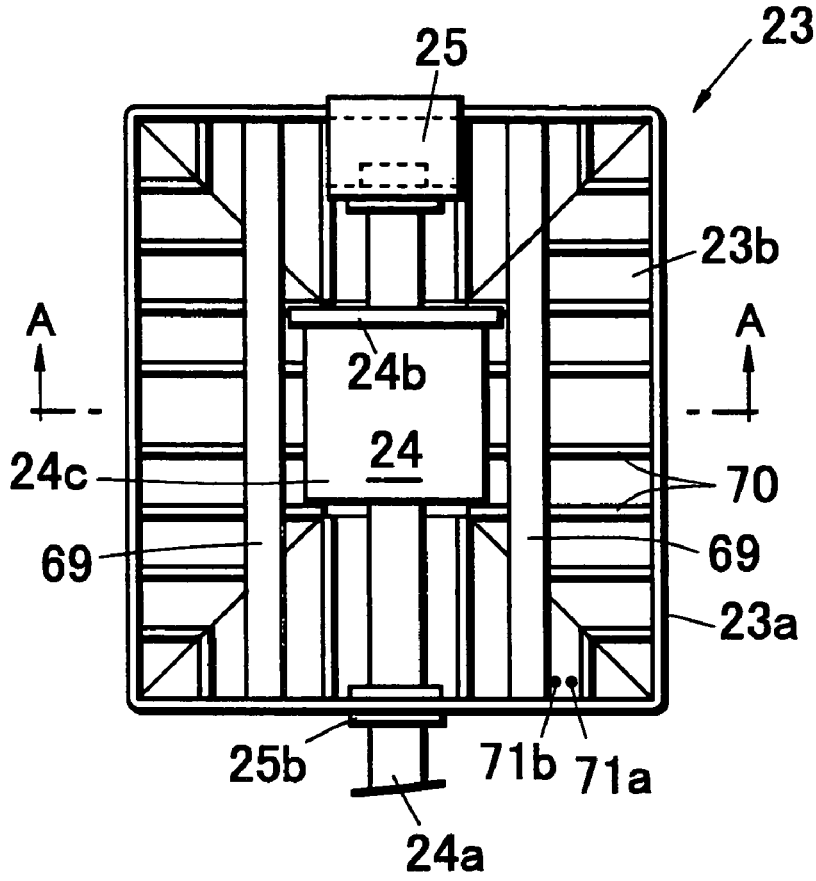
FIG. 12A is a plan view showing a constitution of the adhesive tank and the roller.
Figure 12B:
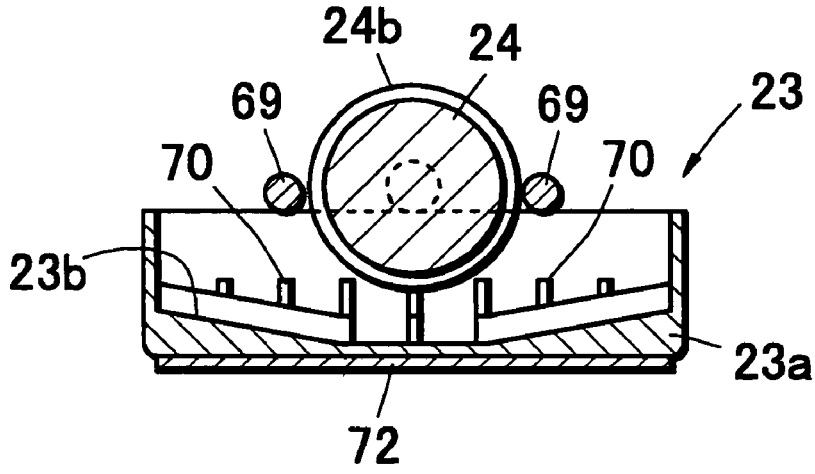
FIG. 12B is a cross-sectional view taken along the line A-A of FIG. 12A.

The roller 24, which is ratatably supported with the adhesive tank 23, includes a main portion 24*c* and a concentric flange portion 24*b* which has a greater diameter than the main portion 24*c* as shown in FIGS. 12A and 12B. Also, a pair of squeegees 69 is disposed on both sides of the roller 24, to scrape off an excess of the adhesive stuck to a surface of the roller 24. Here, an amount of the adhesive to be applied by the roller can be controlled by adjusting a gap between a surface of the roller 24 and the squeegee.

Figure 13:
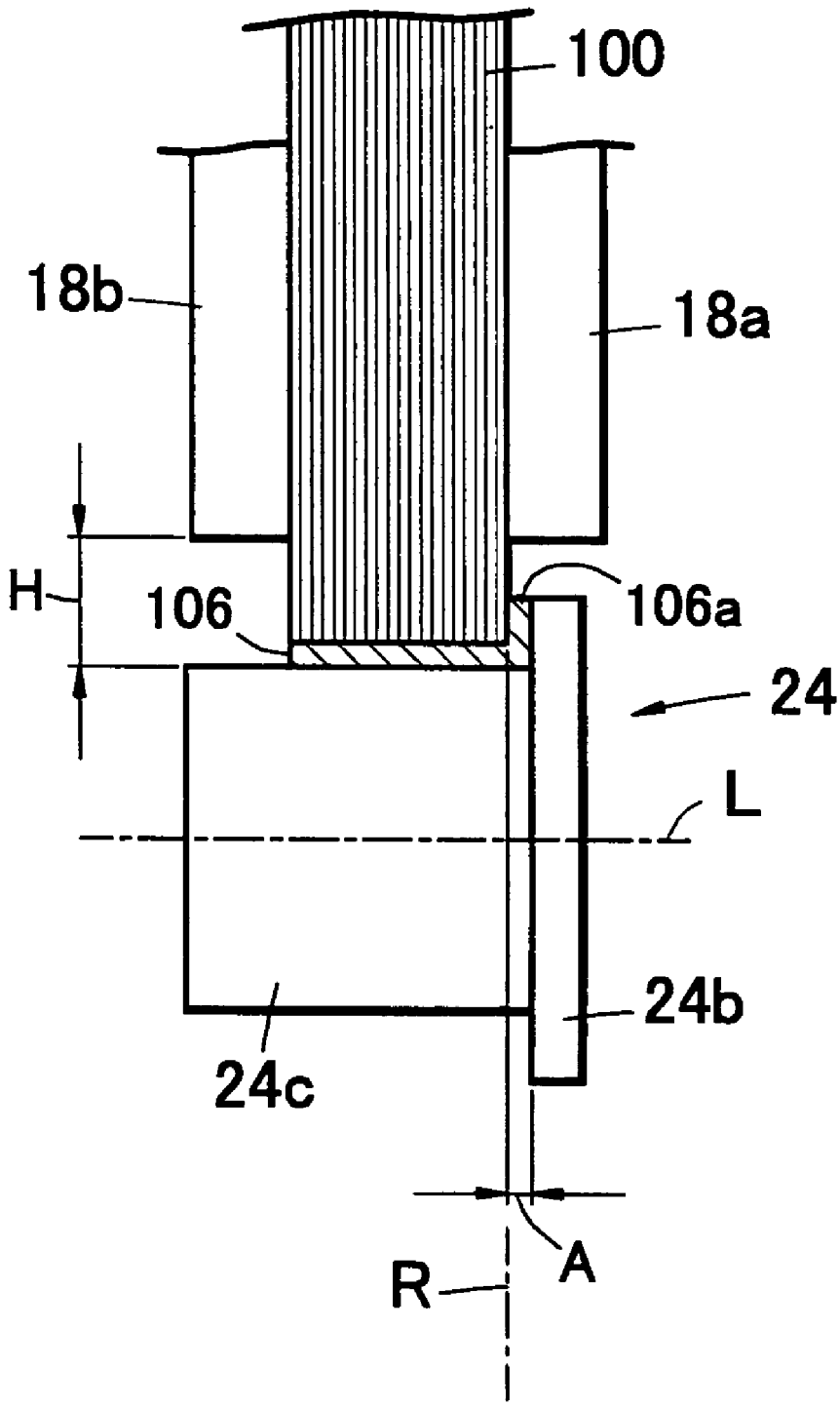
FIG. 13 is a view for explaining a contact position of the roller and a sheet stack.

Based on such structure, application of the adhesive can be efficiently performed by uniformly determining a reference position for a sheet stack through a collaboration of the flanged roller 24 and the fixed clamp 18*a*. Now referring to FIG. 13, a reference position of a sheet stack to be determined in the bookbinding apparatus according to this embodiment will be described. As already stated, the clamp unit 18 includes a fixed clamp 18*a* disposed on a forward side. Accordingly, when setting a sheet stack, a lower end portion of an inner face of the fixed clamp 18*a* can constantly serve as a reference position R corresponding to a lateral face on a forward side of the sheet stack. Therefore, the roller 24 which is to apply the adhesive to a back of the sheet stack is disposed such that the flange portion 24*b* is located at a forward side of the reference position R by a distance A. Because of such flange portion 24*b* included in the roller 24, the adhesive 106*a* stuck to a surface of the flange portion 24*b* is applied to the proximity of a lowermost portion of a front face of the sheet stack 100, in addition to a bottom face 106 thereof. A width of the adhesive to be applied to a lowermost portion of a front face of the sheet stack 100 can be easily adjusted by a height of the flange portion 24*b* of the roller 24. Applying the adhesive in this way to a lowermost portion of a front face of the sheet stack can further strengthen the adhesion of the sheet stack and a cover, thereby resulting in a sturdy finish.

Figure 6:
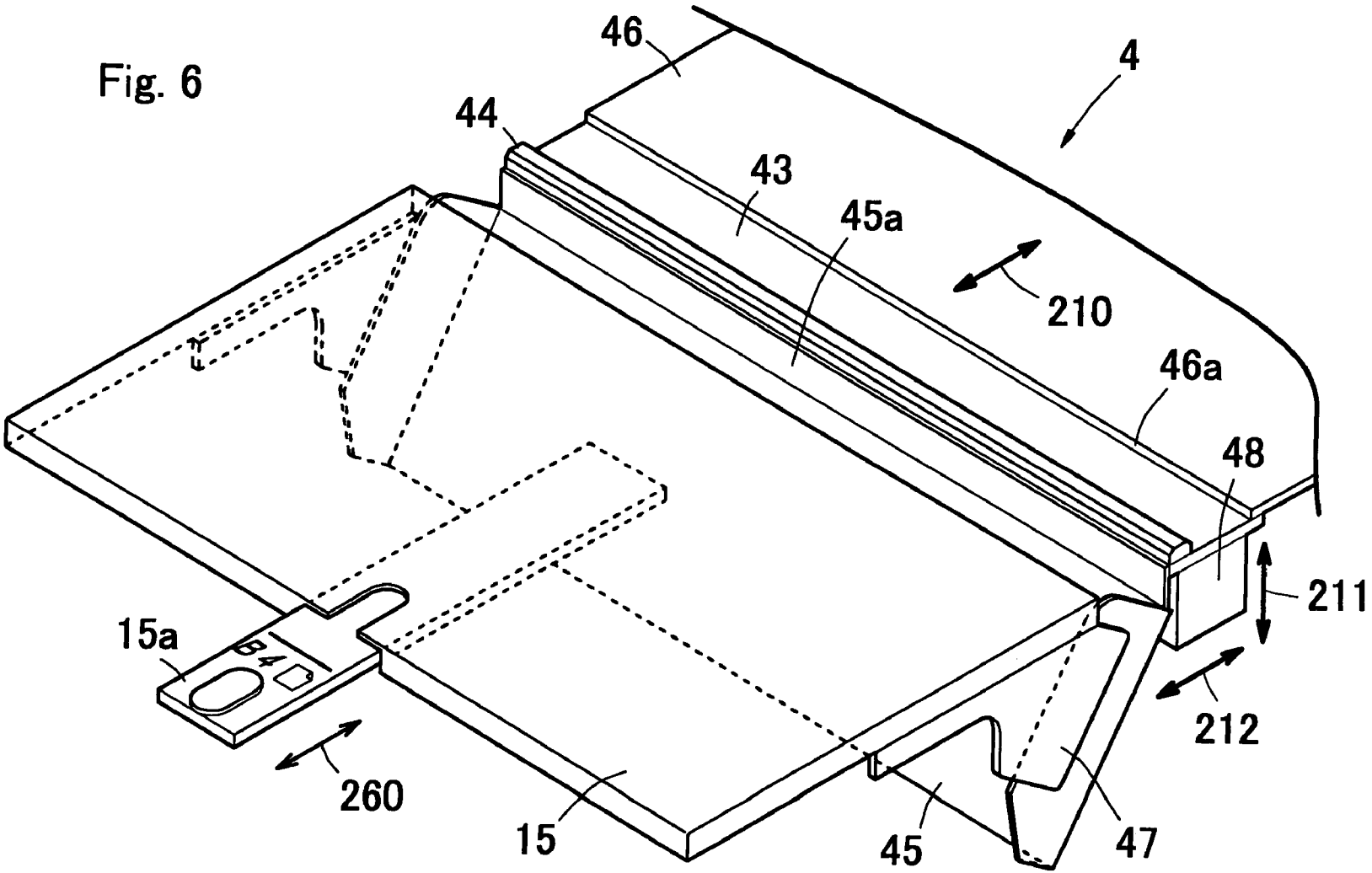
FIG. 6 is a fragmentary perspective view showing a constitution of a pressing unit.

Now the pressing unit will be described. FIG. 6 is a fragmentary perspective view showing a constitution of the pressing unit. As mentioned above, the pressing unit 4 is constituted such that an entire unit can move upward and downward as indicated by the arrow 211, as well as forward and backward as indicated by the arrow 212. The pressing unit includes a fixed plate 43 attached on a base member 48, the cover tray 15 located on a forward side of the fixed plate 43, and a movable plate 46 located on a rear side of the fixed plate 43.

The fixed plate 43 serves as a base to which a lower face of the sheet stack is butted for alignment when in operation, and is provided with a smoothing finish such as a fluororesin coating on upper surface thereof, to prevent the adhesive from sticking thereto in a pad binding process. Along a front side lateral edge of the fixed plate 43, a block bar 44 is provided, for cooperating with the movable plate 46 in folding a cover in a bookbinding operation, as will be later described.

Figure 20D:
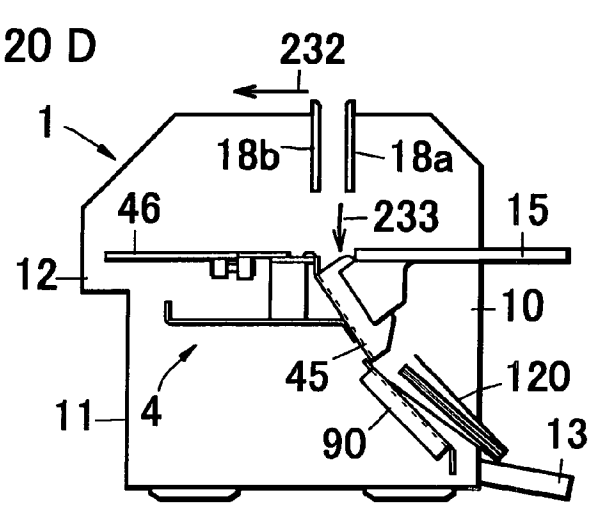

A shooter 45 is provided on a forward side of the fixed plate 43, for discharging a finished book outwardly, as described later. Also, a pair of supporting members 47 is provided on both end portions of the shooter 45, for sustaining the cover tray 15. Accordingly, a gap 45*a* is formed between the fixed plate 43 and the tray cover 15, so that a finished book falls to the shooter 45 through the gap 45*a*, to be discharged out of the apparatus (Ref. FIG. 20D).

Also, the cover tray 15 is provided with a positioning scale 15*a* for a cover arranged on to the cover tray 15, to be used for positioning of a large-sized cover. The positioning scale 15*a* is slidably attached to the cover tray 15 as indicated by the arrow 260, and a size scale showing a cover size is marked on the positioning scale 15*a*, for adjusting a position of a large-sized cover that protrudes from the cover tray 15.

The movable plate 46 is slidably installed as indicated by the arrow 210, so that an interval from the block bar 44 attached to the fixed plate 43 can be adjusted. Specifically, a lateral face 46*a* on a front side of the movable plate 46 and the block bar 44 hold the sheet stack therebetween and press it, to ensure adhesion of the sheet stack and a cover.

Now, operation of the bookbinding apparatus according to this embodiment will be described hereunder. The operation of the bookbinding apparatus 1 is integrally controlled by the control unit 76, and various sensors for detecting an operational status and motors for driving the components are incorporated. FIG. 14 is a block diagram showing a control system of the bookbinding apparatus according to this embodiment.

Figure 19A:
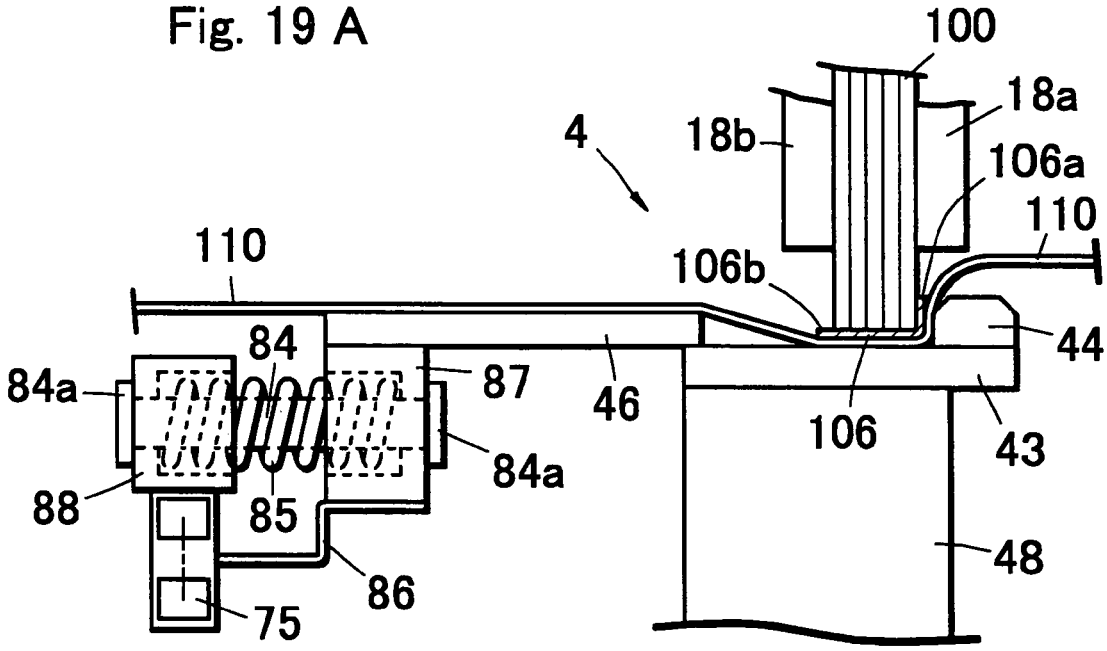
FIGS. 19A and 19B are views for explaining an operation of a pressing force controlling mechanism of the pressing unit.
Figure 19B:
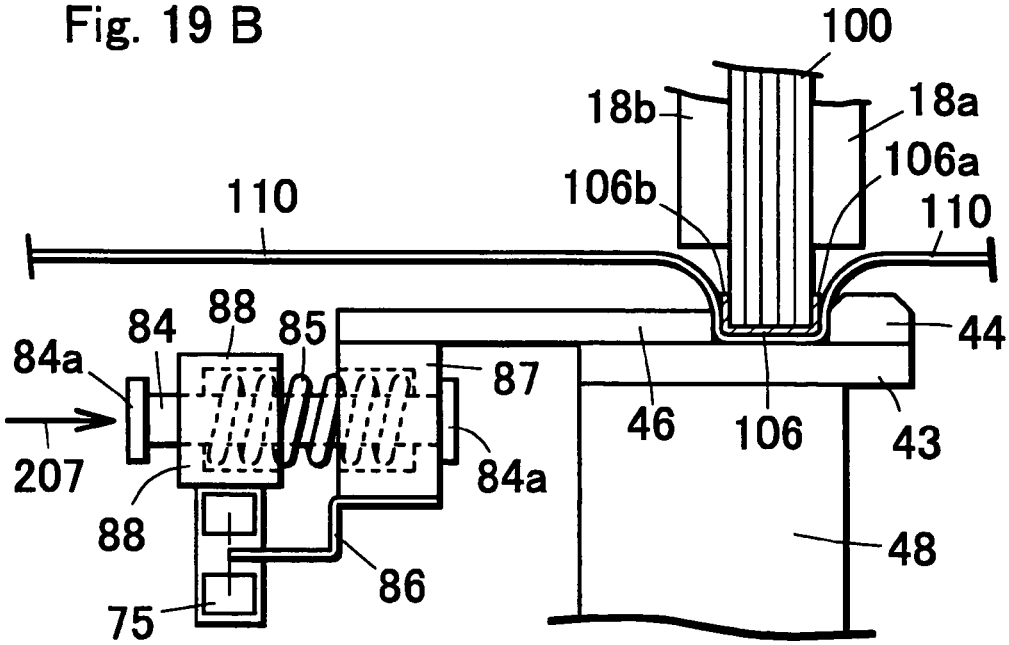

The bookbinding apparatus according to this embodiment includes the following sensors; the sheet stack thickness sensor 34, the first to third adhesive tank position sensors 31*a* to 31*c*, the temperature detecting thermocouple 71*a*, the surface level detecting thermocouple 71*b*, and further a clamp stop sensor 75 (Ref. FIGS. 19A and 19B), an upper clamp sensor 73 and lower clamp sensor 74 (not shown) to be described later. The upper clamp sensor 73 and lower clamp sensor 74 serve for detecting an uppermost position and a lowermost position of the pressing unit 4 in its vertical movement.

Also, the bookbinding apparatus according to this embodiment includes, as driving sources, the roller rotating motor 21 and the partition plate driving motor 53 which have already been described, and further an adhesive tank driving motor 78, clamp motor 79 for forward and backward movement, clamp motor 80 for vertical movement, and a movable plate driving motor 83. The adhesive tank driving motor 78 serves for moving the adhesive tank 23 of the application unit 2, so that the adhesive tank 23 moves together with the roller and the roller rotating motor 21. The clamp motor 79 for forward and backward movement and the clamp motor 80 for vertical movement serve as the driving source for a forward and back movement and an upward and downward movement of the pressing unit 4 respectively. The movable plate driving motor 83 is for driving the movable plate 46 of the pressing unit 4.

Further, the bookbinding apparatus according to this embodiment includes, as an operation unit, the operation panel 16, a ROM 81 and a RAM 82 serving as a storage region and an arithmetic region according to a program on a drive control, and a high-frequency supply source 77 which supplies a high-frequency current to the heating coil 20.

Figure 21:
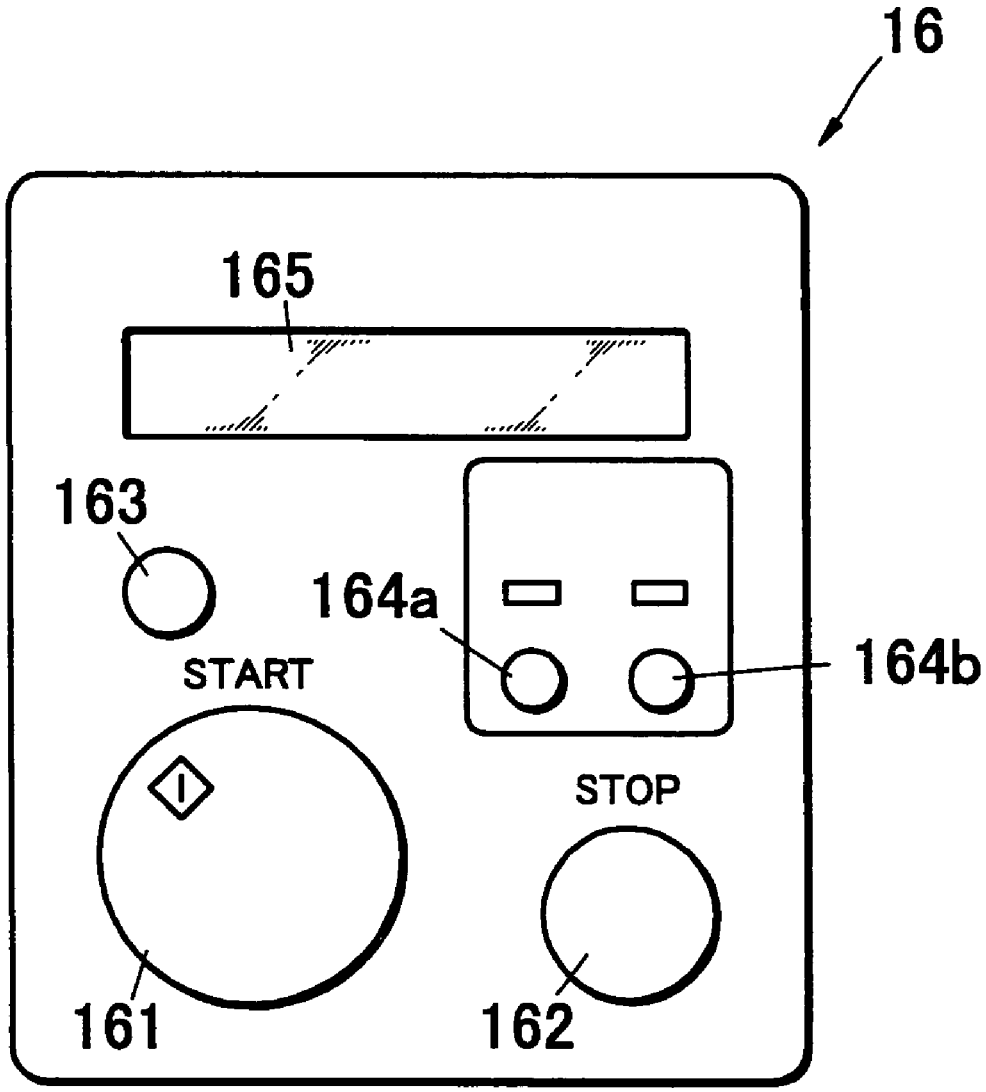
FIG. 21 is a view showing a layout of an operation panel of the bookbinding apparatus of FIG. 1.

The operation panel 16 is provided with switches including a start switch 161, a stop switch 162, a setting switch 163, and bookbinding mode selection switches 164*a* and 164*b*, and display screen 165, as shown in FIG. 21. The start switch is for starting a bookbinding operation in a bookbinding process to be described later, and the stop switch 162 is for suspending a bookbinding operation halfway or for turning off the power. The setting switch 163 serves for setting various values, and the bookbinding mode selection switches 164*a* and 164*b* are used for manual input of a distinction of whether a pad binding or a case binding. The pad binding is a bookbinding mode of applying an adhesive to the sheet stack without a cover to bind the sheet stack alone, while the case binding is the bookbinding mode wherein a cover is used, and the sheet stack face to which an adhesive has been applied and a spine of the cover are bonded together. The display screen 165 displays various instructions related to a progress of the bookbinding operation and information for setting various values.

Figure 15:
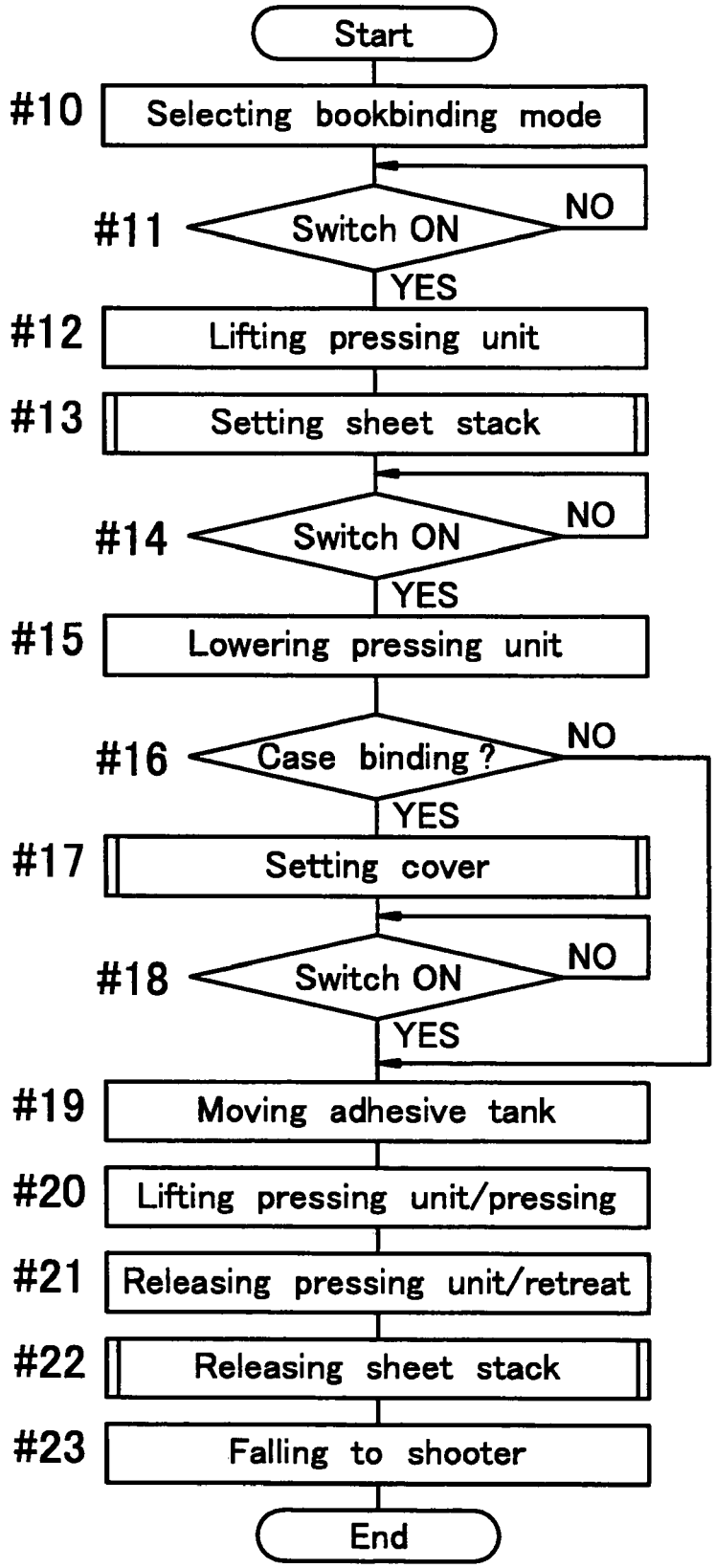
FIG. 15 is a flowchart showing a bookbinding process performed by the bookbinding apparatus according to the embodiment.

FIG. 15 is a flowchart showing a bookbinding process performed by the bookbinding apparatus according to this embodiment. In the bookbinding apparatus, after the power is first turned on, the heating coil heats the adhesive tank, and when the temperature detecting thermocouple 71*a* detects that the adhesive has melted and reached a predetermined temperature, the roller rotating motor 21 is activated to rotate the roller 24 (stand-by state). Since the bookbinding apparatus 1 according to this embodiment has a small-capacity adhesive tank and hence an amount of the adhesive to be melted is small, and since the induction heater which offers a high thermal efficiency is provided, a time before reaching the stand-by state can be significantly shortened compared with a conventional apparatus, and volatilization of the adhesive can also be suppressed. Also, since the deodorizing unit 3 adsorbs ingredients of the adhesive that have volatilized, diffusion of smell can be prevented. At the stand-by state, the following bookbinding operation is performed.

When starting an operation after turning on the power, an operator selects the bookbinding mode (step #10). Selection of the bookbinding mode is performed through manipulating the bookbinding mode selection switch on the operation panel. A signal of the selected mode input by the manipulation on the operation panel is output to the control unit 76 and temporarily stored in the RAM 82.

Figure 16A:
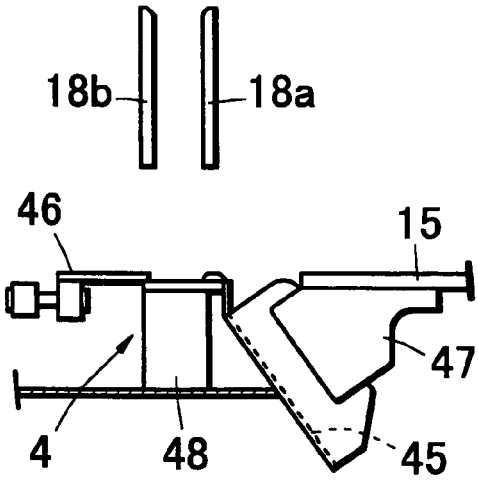
FIG. 16A is a view showing a descending position of the pressing unit.
Figure 16B:
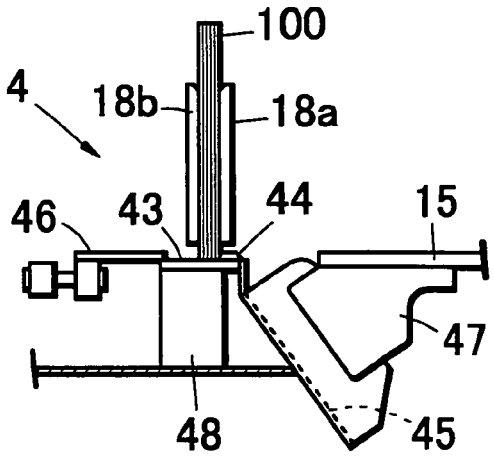
FIG. 16B is a view showing a state of setting the sheet stack after the pressing unit is lifted.

The control unit 76 remains in the stand-by state until a switch on the operation panel 16 is turned on. Once the operator manipulates the start switch 161 and information to the effect that the start switch has been turned on is output (step #11), the control unit 76 activates the clamp motor 80 for vertical movement so that the pressing unit 4 is lifted, (step #12). These steps are shown in FIGS. 16A and 16B. As shown in FIG. 16A, since the pressing unit 4 is at a lower position in the stand-by state, a reference position for a lower face of a sheet stack cannot be determined for setting a sheet stack 100 in the clamp unit 18; therefore, the pressing unit 4 is lifted so as to define a lower face reference position such that an interval between a lower edge of the clamp unit 18 and the fixed plate 43 becomes a predetermined value (8 mm). Then a lower end face of the sheet stack 100 is butted to the fixed plate 43 as shown in FIG. 16B, and the operation knob 14 is rotated to fix the sheet stack in the clamp unit 18 (step #13).

Upon having set the sheet stack 100 in the clamp unit 18, the operator manipulates the start switch 161 on the operation panel 16 again, to emit a signal to such effect (step #14). Once the switch-on signal is emitted, the control unit 76 drives the clamp motor 80 for vertical movement so that the pressing unit 4 is lowered, until detected by the lower clamp sensor 73 (step #15), so as to secure a space between the clamp unit 18 and the pressing unit 4, through which the adhesive tank 23 can move.

In case where the case binding mode is selected, the apparatus temporarily stops the action when the pressing unit 4 has been lowered. At this stage, the operator sets the cover to be used for the case binding, on the cover tray 15 (step #17).

Figure 17:
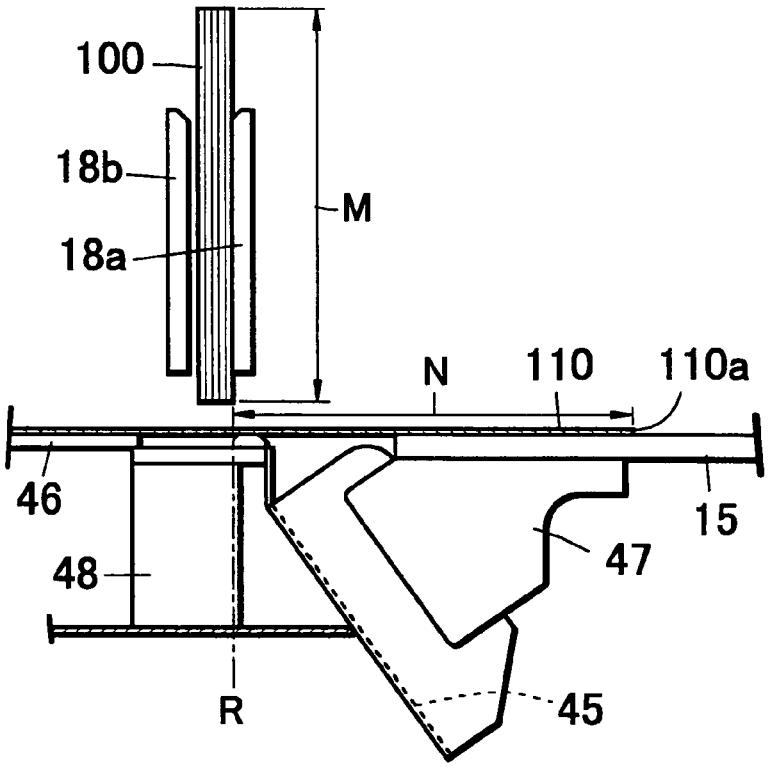
FIG. 17 is a view for explaining a reference position for setting a cover.

The cover setting is performed by placing the cover on the cover tray 15 and the movable plate 46 of the pressing unit 4, as stated above. Since the bookbinding apparatus according to this embodiment is provided with the fixed clamp 18*a* on a forward side of the clamp unit 18 as already mentioned, an edge of the cover can be easily aligned, and positioning can be performed by matching a forward side lateral edge of the cover with the scale marked according to paper sizes. Specifically, as shown in FIG. 17, in case where the papers to be bound fit a predetermined size, a height M of the paper can be uniformly determined. Also, as already mentioned, a lower end portion of an inner face of the fixed clamp 18*a*, which is the reference position R, is always aligned with a forward side lateral edge of the sheet stack 100. Accordingly, a distance N from the reference position R to the forward side lateral edge 110*a* of the cover 110 always matches the height M of the sheet stack, regardless of a thickness of the sheet stack to be bound. In other words, regardless of a thickness of the sheet stack to be bound, the operator can uniformly determine with which position on the cover tray 15 a forward side lateral edge 110*a* of the cover 110 should be aligned. Consequently, a positioning mark to be used when using a standard sized cover can be definitely indicated on the cover tray 15, and resultantly the cover positioning can be easily performed when setting the cover. Also, as already mentioned, in case of an oversized cover that protrudes from the cover tray 15, the positioning scale 15*a* can be drawn out to utilize the scales marked thereon for positioning.

Once the cover 110 has been set the switch on the operation panel 16 is turned on (step #18), and upon receipt of such signal the control unit 76 activates the adhesive tank driving motor 78 to move the adhesive tank 23 (step #19).

Here, in case where the pad binding without a cover is selected as the bookbinding mode, since there is no need of setting a cover, the adhesive tank 23 is caused to move immediately after the start switch 161 is turned on (step #14) and the pressing unit 4 has been lowered, without making a temporary stop.

Along with the travel of the adhesive tank 23, the adhesive is applied to the back portion of the sheet stack 100 via the roller 24. Referring to a rotating direction of the roller, an amount of applied adhesive varies depending on a thickness of the sheet stack, and in case where the sheet stack is thin an amount of the applied adhesive is prone to be insufficient, which may result in a weak adhesion. Accordingly, in this embodiment, a rotating direction of the roller 24 is controlled as follows, according to the bookbinding mode selected. Here, a thickness of the sheet stack is detected by the sheet stack thickness sensor 34 (Ref. FIG. 7), to be distinguished whether thinner than a reference thickness.

Firstly, in case where the case binding is selected as a bookbinding mode, when a thickness of the sheet stack is thicker than a reference thickness (2.0 mm), a rotating direction of the roller is switched in each of the forward and backward travel, and the rotating direction is forward with respect to the sheet stack in the travel of both ways. Specifically, in a forward travel in which the roller 24 moves in a direction indicated by the arrow 205, the roller is rotated in a direction of the arrow 220, and in a backward travel in which the roller 24 moves in a direction of the arrows 206 and 207, the roller is rotated in a direction of the arrow 221. In either case the rotating direction of the roller 24 is a forward direction with respect to a moving direction thereof, i.e. a direction for sequentially applying the adhesive stuck to a surface of the roller 24 to the back of the sheet stack. Here, a timing for switching the rotating direction of the roller 24 is controlled by a signal from the third adhesive tank position sensor 31*c* (Ref. FIG. 8).

Figure 18A:
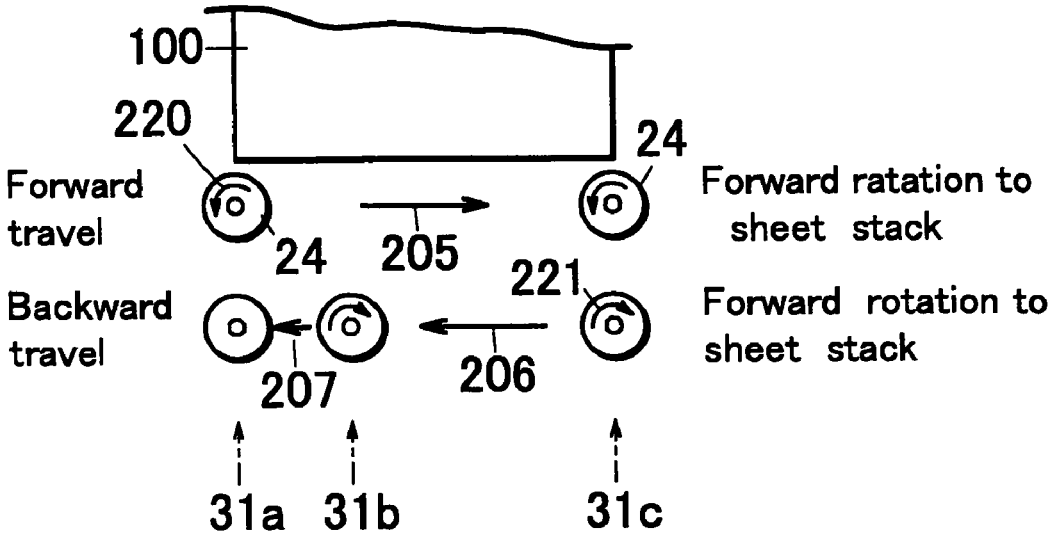
FIG. 18A is an explanatory view showing a rotating direction of the roller during a travel of the adhesive tank in case where a sheet stack is thinner than a reference thickness in a case binding mode.

Referring to FIG. 18A, when the detection piece 32 of the adhesive tank passes the second adhesive tank position sensor

31*b* on the way of a backward travel and such signal is input to the control unit 76, the control unit 76 stops the rotation of the roller 24. Stopping in this way the roller in the proximity of an end portion of the sheet stack 100 prevents excessive application of the adhesive to a lateral end portion of the sheet stack 100, caused by scraping of the adhesive by such portion of the sheet stack.

Figure 18B:
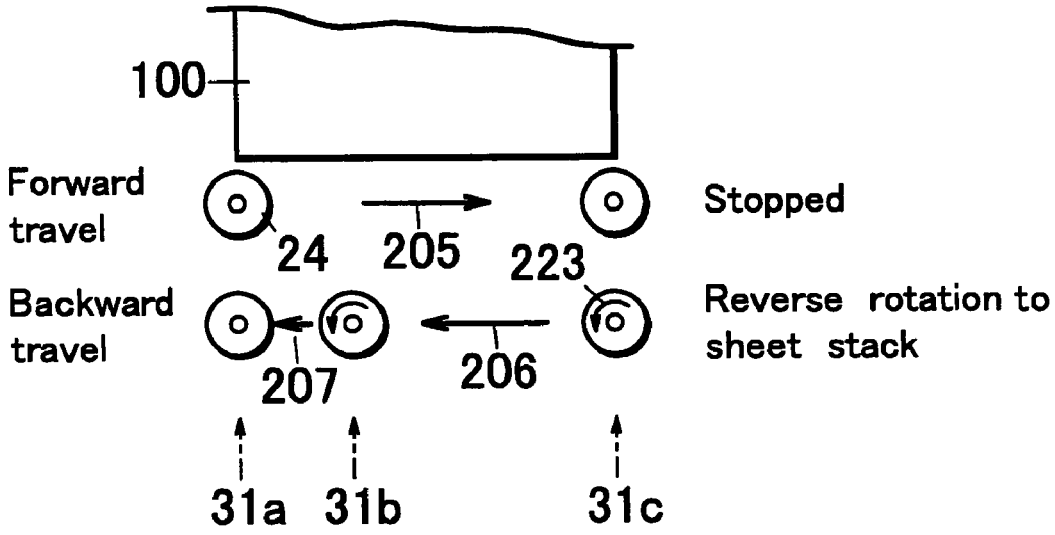
FIG. 18B is an explanatory view showing a roller rotating direction of the roller during a travel of the adhesive tank in case where the sheet stack is thicker than the reference thickness in a case binding mode.

On the other hand, in case where the case binding is selected as a bookbinding mode and the sheet stack is thinner than the reference thickness (2.0 mm), in a forward travel in which the roller 24 moves in a direction indicated by the arrow 205, the rotation of the roller is stopped, and in a backward travel in which the roller 24 moves in a direction of the arrows 206 and 207, the roller is rotated in a direction of the arrow 223, as shown in FIG. 18B. In the backward travel, the roller 24 is rotated in a reverse direction with respect to moving direction thereof. In other words, in the forward travel the roller 24 rotates in such a direction that the adhesive stuck to a surface of the roller 24 is sequentially applied to the back of the sheet stack, and in the backward travel the roller 24 rotates in such a direction that the adhesive stuck to a surface of the roller is scraped off on to the back of the sheet stack. As a result, an increased amount of adhesive is applied in the backward travel, thereby increasing a bonding strength.

In this case also, the rotation of the roller 24 is stopped halfway of the backward travel, to prevent excessive application of the adhesive to a lateral end portion of the sheet stack 100.

Meanwhile, the reference thickness of 2.0 mm adopted in this embodiment has been established as a preferable range through the following experiments. Practically, a bookbinding apparatus according to this embodiment was prepared, and papers and covers a thickness of 0.1 mm were employed in various different thicknesses adjusted by varying a number of sheets to be stacked, to which an adhesive was applied in different ways to examine a bookbinding performance. Decision on whether the adhesive is insufficient was made depending on whether the paper and the cover fall apart when pulled, and the adhesive was regarded as sufficient in case where either the cover or the paper was torn instead of falling apart. Decision on whether the adhesive is excessive was made through a visual examination, in two levels of "excessive" and "rather excessive" among those which had a protrusion of the adhesive. The results are shown in Table 1. In Table 1, a circle stands for an excellent finish of the book, a cross means defective finish, and a triangle represents insufficient adhesion, though apparently a book shape was formed. Based on such experiment, a thickness of the sheet stack of 1.8 to 2.2 mm has been concluded to be a boundary region, and 2.0 mm has been adopted as the reference thickness in this embodiment. Such a thickness range of the sheet stack may vary to a certain extent depending on a nature of an adhesive to be used or an amount of an adhesive to be applied to the roller, however in case where a thickness of most frequently used sheet stack is 25 mm or thinner, a desirable adhesive amount can be obtained in the foregoing range.

Figure 22:
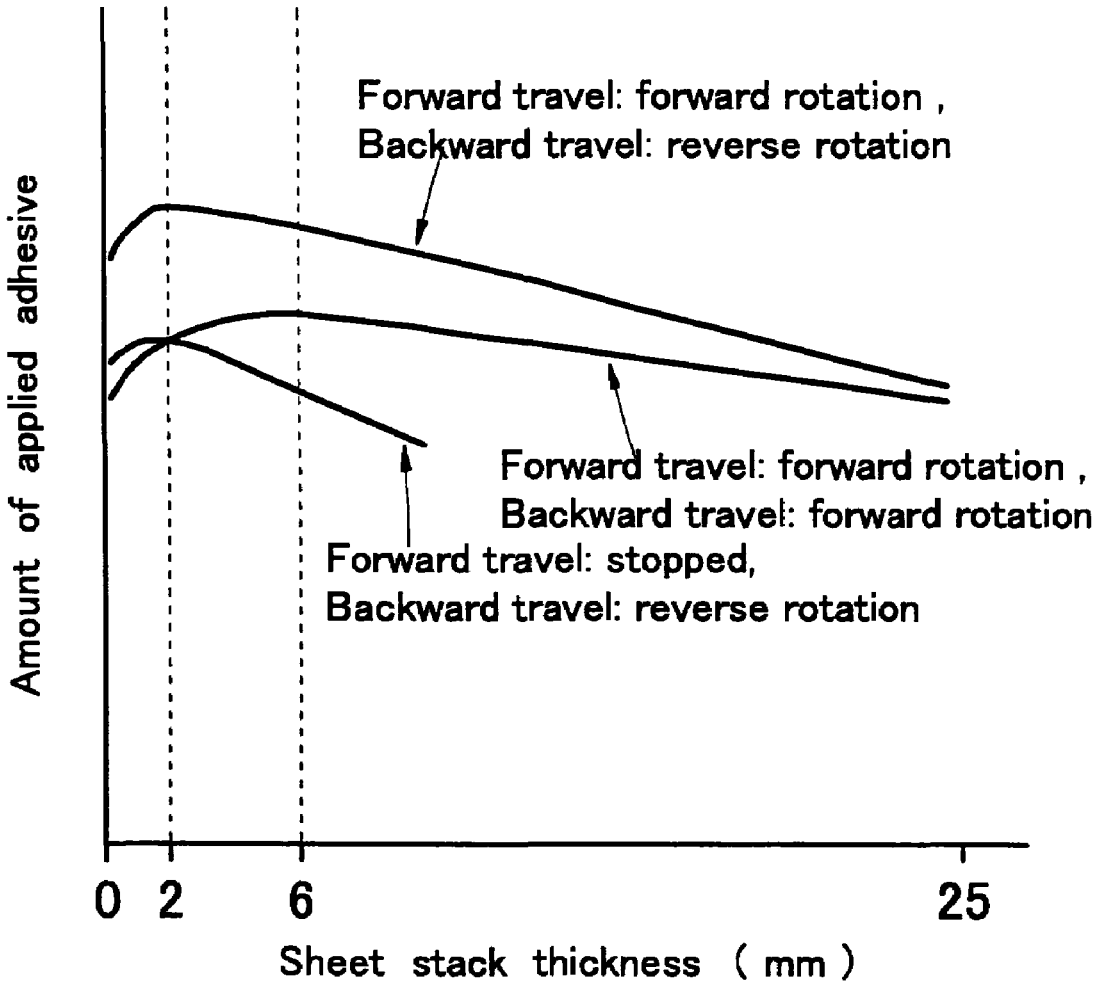
FIG. 22 is a line graph showing a relation between an amount of applied adhesive and a rotating direction of the roller.

Specifically, since a relation as shown in FIG. 22 is observed between an amount of applied adhesive and a rotating direction of the roller, a more amount of adhesive can be applied by stopping the roller in a forward travel and reversely rotating on the way back, as long as a thickness of the sheet stack is approx. 2 mm or thinner, than forwardly rotating in both ways. Also, when the sheet stack is thin, an amount of the applied adhesive largely depend on a rotating direction of the roller, and forwardly rotating the roller in a forward travel but reversely rotating on the way back may result in excessive application, depending on an operational condition. Therefore, as long as the sheet stack is not thicker than approx. 2.0 mm, it is preferable to stop the roller in a forward travel and reversely rotate on the way back to thus prevent insufficient application of the adhesive, while in case where the sheet stack is thicker than 2.0 mm it is preferable to forwardly rotate the roller in both ways.

TABLE 1

| Number of sheets (pieces) | Sheet stack thickness (mm) | Roller rotating direction: Forward travel | Roller rotating direction: Backward travel | Finish grade | Amount of adhesive |
|---|---|---|---|---|---|
| 4 | 0.4 | Forward | Forward | X | Insufficient |
| | | Stopped | Reverse | ○ | Appropriate |
| 6 | 0.6 | Forward | Forward | X | Insufficient |
| | | Stopped | Reverse | ○ | Appropriate |
| 8 | 0.8 | Forward | Forward | X | Insufficient |
| | | Stopped | Reverse | ○ | Appropriate |
| 10 | 1.0 | Forward | Forward | X | Insufficient |
| | | Stopped | Reverse | ○ | Appropriate |
| 12 | 1.2 | Forward | Forward | X | Insufficient |
| | | Stopped | Reverse | ○ | Appropriate |
| 14 | 1.4 | Forward | Forward | X | Insufficient |
| | | Stopped | Reverse | ○ | Appropriate |
| 16 | 1.6 | Forward | Forward | X | Insufficient |
| | | Stopped | Reverse | ○ | Appropriate |
| 18 | 1.8 | Forward | Forward | Δ | Rather insufficient |
| | | Stopped | Reverse | ○ | Appropriate |
| 20 | 2.0 | Forward | Forward | ○ | Appropriate |
| | | Stopped | Reverse | ○ | Appropriate |
| 22 | 2.2 | Forward | Forward | ○ | Appropriate |
| | | Stopped | Reverse | Δ | Rather insufficient |
| 24 | 2.4 | Forward | Forward | ○ | Appropriate |
| | | Stopped | Reverse | X | Insufficient |
| 26 | 2.6 | Forward | Forward | ○ | Appropriate |
| | | Stopped | Reverse | X | Insufficient |
| 28 | 2.8 | Forward | Forward | ○ | Appropriate |
| | | Stopped | Reverse | X | Insufficient |

On the other hand, in case where the pad binding is selected as a bookbinding mode, it is preferable to forwardly rotate the roller 24 in both ways along with the travel of the adhesive tank 23, irrespective of a thickness of the sheet stack. In other words, the roller 24 rotates in such a direction that the adhesive stuck to a surface of the roller 24 is sequentially applied to the back of the sheet stack.

When the adhesive tank returns to the stand-by position at the foregoing step and a signal from the adhesive tank position sensor 31*a* has been received, the control unit 76 drives the clamp motor 80 for vertical movement to lift the pressing unit 4 until detected by the upper clamp sensor 73, and then drives the movable plate driving motor 83 to move the movable plate 46 toward the block bar 44, to thereby press the sheet stack 100 and the cover 110 (step #20).

Two components of the block bar 44 and the movable plate 46 are employed to press the sheet stack 100. At this stage the movable plate 46 is driven by the movable plate driving motor 83, in which case, directly transmitting a driving force of the motor to the movable plate 46 incurs a problem that a pressing force varies depending on a thickness of the sheet stack 100. Accordingly, in this embodiment a driving mechanism of the movable plate 46 is constituted as follows.

A driving force of the movable plate driving motor 83 is transmitted to the movable plate 46 via a pair of blocks 87 and 88 confronting each other via a spring 85. To be more detailed, the first block 87 is located on the side of the movable plate and the second block 88 is located on the side of the movable plate driving motor 83, and an interval between the blocks is adjustable via a supporting shaft 84 penetrating through the both blocks. Since the supporting shaft 84 is inserted in the spring 85 for connecting the blocks, the blocks 87 and 88 are urged in a direction to separate from each other. A flange portion 84*a* is formed on both end portions of the supporting shaft 84, for delimiting a maximum separation of the blocks 87 and 88. A clamp stop sensor 75 constituted of a photointerrupter is located on the side of the second block 88, and a detection piece 86 is disposed at a position corresponding to the clamp stop sensor 75 on the side of the first block.

Accordingly, when the movable plate driving motor 83 is activated to drive the second block 88 toward the fixed plate 43, the first block 87 moves together with the second block 88 because of an urging force of the spring 85. In this way, the movable plate is caused to move when the movable plate driving motor 83 is activated. Thereafter, once a forward end portion of the movable plate 46 makes contact with the sheet stack or the block bar 44, the movable plate 46 is unable to proceed any farther; therefore a movement of the second block is absorbed in a reduction of the interval between the blocks 87 and 88 produced by a shrink of the spring 85.

As shown in FIG. 19A, when the pressing unit 4 is lifted and the cover and the sheet stack make contact with each other, the adhesive 106 applied to the back of the sheet stack 100 is pressed and squeezed out to a side not blocked by the block bar 44 (106*b* of FIG. 19A). In this state, when the movable plate 46 moves toward the block bar, since the movable plate 46 is at a higher level than the fixed plate 43, the cover 46 is folded upward, and the adhesive 106*b* that has been squeezed out adheres to a lowermost portion along an inner lateral face of the sheet stack 100.

At this stage, even though an end portion of the movable plate 46 is butted to the sheet stack 100, the movable plate driving motor 83 keeps driving in a direction indicated by the arrow 207. In this case an interval between the blocks 87 and 88 is gradually shortened, until finally the detection piece 86 meets the photointerrupter (clamp stop sensor 75). Upon receipt of such signal, the control unit 76 stops driving the movable plate driving motor 83. Such constitution permits pressing the sheet stack 100 with a uniform pressure regardless of a thickness thereof.

When a predetermined time necessary for solidification of the adhesive has elapsed with the sheet stack being pressed by the pressing unit 4, the control unit 76 releases the pressing unit 4 (FIG. 20A), and drives the clamp motor 80 for vertical movement so that the pressing unit 4 is lowered as indicated by the arrow 230, until detected by the lower clamp sensor 74 (FIG. 20B), and further drives the clamp motor 79 for forward and backward movement to cause the pressing unit 4 to retreat as indicated by the arrow 231 (FIG. 20C, step #21). When the pressing unit 4 has retreated, the shooter 45 is exposed right under the sheet stack. Inside the bookbinding apparatus, a slider 90 is installed close to a retreating position of the shooter 45; therefore when the lower front door 13 under the front housing is opened up, a discharging path from the shooter 45 to outside the apparatus can be constituted as indicated by the arrow 209 in FIG. 20A.

When the operating knob 14 is manipulated to release the clamp as indicated by the arrow 232 (FIG. 20D), a finished book 120 passes through the gap 45*a* provided in front of the fixed plate 43 and falls into the shooter 45, to then slide down along the slider 90 and be discharged out of the bookbinding apparatus 1.

As described throughout the foregoing passages, according to the bookbinding apparatus of this embodiment, the adhesive tank 23 is heated only at the stand-by position and a non-contact induction heater which offers a high thermal efficiency is employed for heating; therefore a system in which the adhesive tank moves can be adopted. As a result, the adhesive tank 23 can be designed in small dimensions, and a start-up time can be shortened, and also smell of the adhesive that volatilizes from the adhesive tank can be reduced.

Also, since the adhesive tank 23 is constituted of a main body of a non-ferromagnetic material and a heating plate, the main body of the adhesive tank is not directly heated; therefore overheating of the adhesive at a contact area of the adhesive and the adhesive tank, and hence scorching of the adhesive can be prevented. Further, since the roller is also constituted of a non-ferromagnetic material, the adhesive can be prevented from being overheated on a surface of the roller.

Also, since the adhesive tank is provided with an inner bottom face inclined toward a position where the roller is installed, the adhesive gathers close to the roller even though the adhesive in the adhesive tank has been consumed, and therefore the roller can be sufficiently dipped in the adhesive even when a surface level of the adhesive has dropped.

Also, according to the bookbinding apparatus of this embodiment, since an appropriate amount of adhesive pellets are automatically supplied by the adhesive supply unit, when a decrease of the adhesive in the adhesive tank due to consumption has been detected, shortage of the adhesive is not incurred in the adhesive tank despite constituting the adhesive tank in small dimensions for the purpose of moving the adhesive tank. Further, an adhesive of a pellet form is used in the adhesive supply unit so that the adhesive pellets can roll down through an inclined duct, and besides a predetermined amount of adhesive pellets is automatically supplied each time through an arrangement with two partition plates. Therefore, a transport mechanism for the adhesive and an adhesive measuring mechanism are not required, and accordingly the bookbinding apparatus can be constituted in a compact size. Also, since the adhesive supply unit is installed at an opposite position across the sheet stack to the stand-by position, which is also a heating position of the adhesive tank, i.e. at a separate position from the heat source of the adhesive tank, the adhesive stored in the adhesive supply unit does not melt owing to the heat from the hearing device of the adhesive tank, and besides a problem of the smell diffusing from the adhesive can be eliminated.

Further, according to the bookbinding apparatus of this embodiment, in view of the new findings that an amount of applied adhesive varies depending on a moving direction and a rotating direction of the roller, operation of the roller is constituted such that a rotating direction is switched in each of the forward and backward travel, i.e. the roller is stopped in a forward travel, but is reversely rotated against a sheet stack with respect to its moving direction on its way back so that the adhesive is scraped off by the back of the sheet stack and resultantly an increased amount of adhesive is applied to the sheet stack, in case where the sheet stack is thinner than a predetermined reference thickness (2.0 mm). On the other hand, in case where the sheet stack is thicker than the reference thickness, the roller is rotated in a forward direction in both of the forward and backward travels, in order to increase an amount of applied adhesive.

Further, at a final edge the sheet stack, the roller is stopped in the proximity of the final end portion of the sheet stack in order to prevent the adhesive from being scraped off by the final edge so that an excessive amount of adhesive is not stuck to the end portion of the sheet stack. In this way, since a portion of adhesive remaining on a surface of the roller is spread over the sheet stack, and therefore the excessive application of the adhesive can be prevented.

The present invention is not limited to the foregoing embodiment, but is practicable in various other aspects.

Also, an appropriate combination of any of the components or constitutions in the foregoing embodiment can also provide an effect duly expected from those components or constitutions.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

INDUSTRIAL APPLICABILITY

According to the bookbinding apparatus of the present invention, since the adhesive tank is contactlessly heated in a stand-by state, the adhesive tank can easily be constituted to be movable, and because of constituting such that the adhesive tank moves in an adhesive application process, the bookbinding apparatus can be constituted in a small width and also a capacity of the adhesive tank can be made smaller, thereby reducing a smell of the adhesive diffusing from the adhesive tank. Consequently, the bookbinding apparatus according to the present invention is appropriate as a compact and simple bookbinding apparatus to be used in an office, school, home, etc.

The invention claimed is:

1. A bookbinding apparatus comprising:

a movable adhesive tank constituted of a material containing a ferromagnetic material for retaining therein an adhesive melted by heat;

a roller rotatably supported with the adhesive tank so as to dip a lower portion thereof in the adhesive retained in the adhesive tank, for applying the adhesive to a sheet stack along a lateral edge thereof;

a holding unit capable of holding the sheet stack;

an adhesive tank carrier for disposing the adhesive tank and the roller at a stand-by position located outside a longitudinal end face of the sheet stack held by the holding unit in a stand-by stage, and moving the adhesive tank and the roller together from the stand-by position in a longitudinal direction of the sheet stack substantially through an entire area under a back face thereof in a bookbinding stage; and a non-contact heater provided with an electromagnetic induction heating coil for contactlessly heating the adhesive tank, and the non-contact heater is immovably placed at the stand-by position to melt the adhesive.

2. The bookbinding apparatus according to claim 1, wherein the adhesive tank Is provided with a container-shaped main body of a non-ferromagnetic malarial for retaining therein the adhesive and a ferromagnetic heating portion located on an outer surface of the main body; and the non-contact heater is located so as to confront the heating portion of the adhesive tank placed at the stand-by position.

3. The bookbinding apparatus according to claim 1, wherein the roller is constituted of a non-ferromagnetic material.

4. The bookbinding apparatus according to claim 1, wherein the adhesive tank is provided with an inclined bottom nil in an adhesive retaining region of a container-shaped main body of the adhesive tank to retain the adhesive therein, for providing a deeper portion corresponding to a position of the roller.

5. The bookbinding apparatus according to claim 1, wherein the adhesive tank is provided with a fin for promoting melting of the adhesive, erected on a bottom nil in the adhesive retaining region of the container-shaped main body of the adhesive tank to retain the adhesive therein.

6. The bookbinding apparatus according to claim 1, further comprising:

an adhesive supply unit installed opposite to the stand-by position of the adhesive tank across the sheet stack, including a storing section for storing therein adhesive pellets to be transformed into the melted adhesive retained in the adhesive tank, a pellet supply path downwardly extending from a bottom portion of the storing section, and a pellet outlet through which the adhesive pellets transferred through the pellet supply path are discharged; and an adhesive supply control unit for controlling a supplying timing of the adhesive pellets from the adhesive supply unit, such that a predetermined amount of adhesive pellets is discharged from the pellet outlet to the adhesive tank at a time that the adhesive tank has reached a position where the adhesive tank can receive the adhesive pellets discharged from the pellet outlet, thereby the adhesive pellets supplied into the adhesive tank are melted.

7. The bookbinding apparatus according to claim 6, further comprising:

a level detection unit for detecting a surface level of the adhesive retained in the adhesive tank;

wherein the adhesive supply control unit supplies the adhesive pellets until the adhesive surface exceeds a reference level, when the adhesive surface level has been detected to be lower than the reference level by the level detection unit.

8. The bookbinding apparatus according to claim 6, further comprising:

two openable partition plates disposed inside the supply path with a predetermined interval therebetween, so that a predetermined amount of adhesive pellets are stored between the partition plates;

wherein the adhesive supply control unit open or close the two partition plates independently.

9. The bookbinding apparatus according to claim 8, wherein each of the two partition plates is of a disk shape with an opening, and are fixed by a shaft disposed substantially parallel to the supply path such that a rotation phase of the opening of the respective partition plates is different from each other; and the adhesive supply control unit drives the shaft to rotate such that only one of the partition plates permits a communication through the supply path.

10. The bookbinding apparatus according to claim 1, further comprising:

a binding mode selection unit for selecting a bookbinding mode according to a signal identifying whether a case binding mode of binding a sheet stack with a cover or a pad binding mode of binding a paper pad without a cover; and a rotation control unit for switching a roller controlling mode according to the bookbinding mode selected by the bookbinding mode selection unit.

11. The bookbinding apparatus according to claim 10, wherein the adhesive tank carrier serves to move the adhesive tank and the roller back and forth in a longitudinal direction of the sheet stack; and the rotation control unit rotates the roller in a forward direction with respect to a moving direction thereof, during both of the forward and backward travels of the adhesive tank, when a pad binding mode in which a cover is not provided to the sheet stack is selected by the bookbinding mode selection unit.

12. The bookbinding apparatus according to claim 10, wherein the adhesive tank carrier serves to move the adhesive tank and the roller back and forth in a longitudinal direction of the sheet stack; and the rotation control unit rotates the roller in a different direction according to a moving direction thereof.

13. The bookbinding apparatus according to claim 12, further comprising:

a thickness detecting device for detecting a thickness of the sheet stack held by the holding unit; wherein the rotation control unit stops a rotation of the roller during a forward travel of the adhesive tank but rotates the roller in a reverse direction with respect to the moving direction during a backward travel of the adhesive tank when a thickness of the sheet stack has been detected to be equal to or thinner than a reference thickness, while the rotation control unit rotates the roller in a forward direction with respect to a moving direction thereof during both of the forward and backward travels of the adhesive tank, when a thickness of the sheet stack has been detected to be thicker than the reference thickness, in case where the case binding mode of providing a cover to the sheet stack is selected by the bookbinding mode selection unit.

14. The bookbinding apparatus according to claim 13, wherein the reference thickness is in a range of 1.8 to 2.2 mm.

15. The bookbinding apparatus according to claim 13, further comprising:

a position detection unit for detecting a position of the adhesive tank;

wherein, once the adhesive tank reaches a predetermined position during a backward travel of the adhesive tank, the rotation control unit stops the rotation of the roller during the subsequent travel of the adhesive tank from the predetermined position to a final edge of the sheet stack.

* * * * *